US008722947B2

(12) United States Patent
Sugano

(10) Patent No.: US 8,722,947 B2
(45) Date of Patent: May 13, 2014

(54) GAS OIL COMPOSITION

(75) Inventor: Hideaki Sugano, Yokohama (JP)

(73) Assignee: Nippon Oil Corporation, Yokohama-shi, Kanagawa (JP)

( * ) Notice: Subject to any disclaimer, the term of this patent is extended or adjusted under 35 U.S.C. 154(b) by 993 days.

(21) Appl. No.: 12/295,474

(22) PCT Filed: Mar. 9, 2007

(86) PCT No.: PCT/JP2007/055309

§ 371 (c)(1),
(2), (4) Date: Sep. 30, 2008

(87) PCT Pub. No.: WO2007/114028

PCT Pub. Date: Oct. 11, 2007

(65) Prior Publication Data

US 2010/0223838 A1 Sep. 9, 2010

(30) Foreign Application Priority Data

Mar. 31, 2006 (JP) ..... 2006-101232
Mar. 31, 2006 (JP) ..... 2006-101233
Mar. 31, 2006 (JP) ..... 2006-101234
Mar. 31, 2006 (JP) ..... 2006-101235

(51) Int. Cl.
*C10L 1/16* (2006.01)
*C10L 1/00* (2006.01)

(52) U.S. Cl.
USPC ..... 585/14; 585/1; 208/15; 208/16; 208/17; 44/300; 44/385

(58) Field of Classification Search
USPC ..... 44/300, 385, 383; 585/1, 14, 15–17; 208/15–17, 1, 14
See application file for complete search history.

(56) References Cited

U.S. PATENT DOCUMENTS 6,890,423 B2 * 5/2005 O'Rear ..... 208/62
2002/0020107 A1 * 2/2002 Bailey et al. ..... 44/447
2008/0076949 A1 3/2008 Dancuart et al.
2009/0044444 A1 2/2009 Sugano

FOREIGN PATENT DOCUMENTS

JP 2004-002550 A 1/2004
JP 2004-002551 A 1/2004

(Continued)

OTHER PUBLICATIONS

JISK 2204 (Japanese Industrial Standards-diesel Fuel).*

(Continued)

*Primary Examiner* — Pamela H Weiss
(74) *Attorney, Agent, or Firm* — Panitch Schwarze Belisario & Nadel LLP

(57) ABSTRACT

The present invention provides a gas oil composition for use in a diesel engine containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 380° C. or lower in distillation characteristics, wherein: (1) the cetane number in a fraction range of lower than 200° C. is 20 or greater and less than 40; (2) the cetane number in a fraction range of 200° C. or higher and lower than 280° C. is 30 or greater and less than 60; and (3) the cetane number in a fraction range of 280° C. or higher is 50 or greater.

12 Claims, 1 Drawing Sheet

(56) References Cited

FOREIGN PATENT DOCUMENTS

| | | | | |
|---|---|---|---|---|
| JP | 2004-269682 | A | | 9/2004 |
| JP | 2005-343917 | A | | 12/2005 |
| JP | 2005-343918 | A | | 12/2005 |
| JP | 2005-343919 | A | | 12/2005 |
| JP | 2006016541 | A | * | 1/2006 |
| JP | 2006-028493 | A | | 2/2006 |
| WO | WO 2005035695 | A2 | * | 4/2005 |
| WO | 2005059063 | A1 | | 6/2005 |

OTHER PUBLICATIONS

Szymkowicz, Patrick G. et al.; "Effects of Advanced Fuels on the Particulate and NOx Emissions from an Optimized Light-Duty CIDI Engine", SAE Technical Paper Series, 2001, 2001-01-0148.

Ryan III, Thomas W. et al.; "HCCI in a Variable Compression Ratio Engine-Effects of Engine Variables", SAE Technical Paper Series, 2004, 2004-1-1971.

Sugano, Hideaki et al.; "An Experimantal Study of Effects of Combustion and fuel Factors on DI Diesel Engine Performance (Second Report)", Society of Automotive Engineers of Japan Gakujutsu Koenkai Maesurishu, 2005 Nen, No. 91-05, pp. 1-6.

Int'l Search Report dated Apr. 17, 2007 for Int'l Application No. PCT/JP2007/055298.

EP Supplemental Search Report issued Jun. 22, 2011 in EP Application No. 07738756.

Office Action Issued Apr. 21, 2011 in U.S. Appl. No. 12/295,299.

* cited by examiner

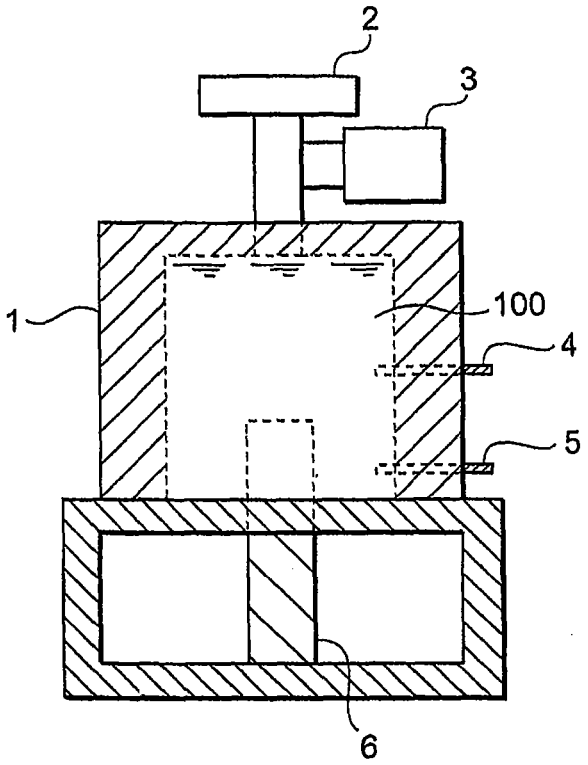
2
3
1
100
4
5
6

GAS OIL COMPOSITION

CROSS-REFERENCE TO RELATED APPLICATIONS

This application is a Section 371 of International Application No. PCT/JP2007/055309, filed Mar. 9, 2007, which was published in the Japanese language on Oct. 11, 2007, under International Publication No. WO 2007/114028 A1, and the disclosure of which is incorporated herein by reference.

BACKGROUND OF THE INVENTION

The present invention relates to gas oil compositions, more specifically to gas oil compositions for a summer or winter season, suitable for both diesel combustion and homogeneous charge compression ignition combustion.

Diesel combustion is referred to as combustion wherein ignition occurs (premixed combustion) when fuel injected to an engine combustion chamber evaporates, mixes with air and becomes a premixed gas with an appropriate fuel/oil ratio, and the gas undergoes an appropriate temperature condition. It is often the case that whether this ignition is good or poor is determined by evaluating the evaporation characteristics resulting from the distillation characteristics and cetane number indicating the self-ignition properties of fuel. If a higher output is required in the diesel combustion (high load conditions), it is necessary to continue the injection of fuel even after the self-ignition occurs. In this case, the fuel must be combusted while the injected fuel is diffused in air atmosphere using fluidized air in the interior of the engine combustion chamber (diffusive combustion). Therefore, what are demanded for fuel characteristics are those to assist premixed combustion and diffusive combustion.

There is a combustion mode referred to as homogeneous charge compression ignition combustion deriving from these diesel combustion modes, and recently this combustion mode has brought attention because of the low emission properties and excellent fuel efficient properties. This combustion mode is different from the foregoing diesel combustion in that the whole combustion process of the former is premixed combustion and thus is not involved with diffusive combustion. However, as described above, ignition undesirably occurs due to the self-ignition properties of fuel and thus it is regarded as difficult to control ignition under high load conditions in particular. Therefore, there are many engines employing a combustion mode wherein homogenous charge compression ignition combustion is carried out only under low and middle load conditions and switched to a normal diesel combustion under high load conditions. Therefore, it can be concluded that what are demanded for fuel characteristics are those to have both a factor to assist homogenous charge compression ignition combustion in low load conditions and a factor to assist diesel combustion under high load conditions.

In general, a gas oil composition is produced by blending one or more types of base oils produced by subjecting a straight gas oil or straight kerosene, produced by atmospheric distillation of crude oil to hydrorefining or hydrodesulfurization. In particular, it is often the case that the blend ratio of the foregoing kerosene base oil and gas oil base oil is adjusted in order to ensure the cold flowability during a winter season. If necessary, the base oils are blended with additives such as cetane number improvers, detergents and cold flow improvers (see, for example, Non-Patent Document No. 1 below).

With regard to fuel for the above-described homogenous charge compression ignition combustion, Patent Document No. 1 discloses a diesel gas oil composition characterized in that it contains a relatively light catalytic cracked gas oil and is low in cetane number and high in density and aromatic content. This document describes that this composition can have both excellent low-temperature properties and low NOx and low PM properties in a homogenous charge compression ignition combustion application. However, it is easily anticipated that the aromatic content of the composition will be extremely large, leading to an increase in discharge of unburnt fuel. Further, as described above, it is currently often the case that homogenous charge compression ignition combustion is used in parallel with the conventional diesel combustion. It is thus apparent that the fuel of this document with a low cetane number, a high density and a high aromatic content is not suitable at all for homogenous charge compression ignition combustion. Further, it is also easily anticipated that soot or deposit will adhere to injection nozzles or EGR (exhaust gas recycle) control valves, due to the high aromatic content. Therefore, the diesel gas oil composition of this document fundamentally fails to be an environment friendly fuel. Similarly, Patent Document Nos. 2, 3 and 4 disclose that fuel compositions with distillation characteristics defined by functioning are effective for homogenous charge compression ignition combustion. However, as described above, distillation characteristics is not chemically involved with a factor to control the self-ignition properties of fuel, and in particular on the assumption of an improvement in homogenous charge compression ignition combustion of type wherein fuel is injected in an earlier stage, as proposed by the present invention, distillation characteristics are still less effective. An index which is defined by the temperature every certain distillate volume such as T90 but not by fraction volume can be a rough standard to learn the identity of fuel but does not make sense since it is not an absolute quantitative definition. Further, these fuel compositions are kept down in cetane number but are then likely to be reduced in the content of saturated hydrocarbon compounds and thus can be regarded as fuels which can not control ignition any time. Therefore, it is apparent that the characteristic definitions proposed by these documents can not be regarded as fuel characteristics that can control self-ignition, and then it is presumable that no environment friendly fuel has not accomplished yet.

Further, the environment friendly fuel is necessarily optimized in fuel characteristics every season in view of the environment where it is used. Fuel with excessively lightened distillation characteristics may often cause the seizure of injection pumps, cavitation damages and problems in high-temperature startability.

That is, it is very difficult to design a high-quality fuel that can achieve at a high level both the requirements sought for a gas oil composition having both an excellent practical performance under conditions in a summer or winter season and environment friendly properties that can be applied to homogenous charge compression ignition combustion, and there exists no example or finding on the basis of studies of such a fuel satisfying various properties required for fuel other than the foregoing sufficiently and a practical process for producing the fuel.

(1) Patent Document No. 1: Japanese Patent Laid-Open Publication No. 2006-28493

(2) Patent Document No. 2: Japanese Patent Laid-Open Publication No. 2005-343917

(3) Patent Document No. 3: Japanese Patent Laid-Open Publication No. 2005-343918

(4) Patent Document No. 4: Japanese Patent Laid-Open Publication No. 2005-343919

(5) Non-patent document No. 1: Konishi Seiichi, "Nenryo Kogaku Gairon", Shokabo Publishing Co., Ltd., March, 1991, pages 136 to 144

BRIEF SUMMARY OF THE INVENTION

The present invention was made in view of the above-described situations and has an object to provide a gas oil composition for the use in a summer or winter season suitable for both diesel combustion and homogenous charge compression ignition combustion. The present invention was completed as the result of extensive study and research carried out to solve the foregoing problems.

That is, the present invention provides a gas oil composition for use in a diesel engine with a geometric compression ratio of greater than 16, equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 380° C. or lower in distillation characteristics, and the following characteristics (1) to (3) in each fraction range wherein:

(1) the cetane number in a fraction range of lower than 200° C. is 20 or greater and less than 40;

(2) the cetane number in a fraction range of 200° C. or higher and lower than 280° C. is 30 or greater and less than 60; and (3) the cetane number in a fraction range of 280° C. or higher is 50 or greater.

The present invention also provides the foregoing gas oil composition with quality items fulfilling the JIS No. 1 grade gas oil standards other than sulfur content for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 380° C. or lower in distillation characteristics, and the following characteristics (1) to (3) in each fraction range wherein:

(1) the cetane number in a fraction range of lower than 200° C. is 20 or greater and less than 40, and the component ratio of the fraction in the whole fraction volume is 1 percent by volume or more and less than 10 percent by volume;

(2) the cetane number in a fraction range of 200° C. or higher and lower than 280° C. is 30 or greater and less than 60, and the component ratio of the fraction in the whole fraction volume is 40 percent by volume or more and 98 percent by volume or less; and (3) the cetane number in a fraction range of 280° C. or higher is 50 or greater, and the component ratio of the fraction in the whole fraction volume is 1 percent by volume or more and 59 percent by volume or less.

The present invention also provides the foregoing gas oil composition with quality items fulfilling the JIS No. 2 grade gas oil standards other than sulfur content for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 360° C. or lower in distillation characteristics, and the following characteristics (1) to (3) in each fraction range wherein:

(1) the cetane number in a fraction range of lower than 200° C. is 40 or greater and less than 60, and the component ratio of the fraction in the whole fraction volume is 10 percent by volume or more and less than 20 percent by volume;

(2) the cetane number in a fraction range of 200° C. or higher and lower than 280° C. is 60 or greater and less than 80, and the component ratio of the fraction in the whole fraction volume is 30 percent by volume or more and 89 percent by volume or less; and (3) the cetane number in a fraction range of 280° C. or higher is 50 or greater, and the component ratio of the fraction in the whole fraction volume is 1 percent by volume or more and 60 percent by volume or less.

The present invention also provides the foregoing gas oil composition with quality items fulfilling the JIS No. 3 grade gas oil standards other than sulfur content for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 360° C. or lower in distillation characteristics, and the following characteristics (1) to (3) in each fraction range wherein:

(1) the cetane number in a fraction range of lower than 200° C. is 40 or greater and less than 60, and the component ratio of the fraction in the whole fraction volume is 20 percent by volume or more and less than 40 percent by volume;

(2) the cetane number in a fraction range of 200° C. or higher and lower than 280° C. is 60 or greater and less than 80, and the component ratio of the fraction in the whole fraction volume is 30 percent by volume or more and 78 percent by volume or less; and (3) the cetane number in a fraction range of 280° C. or higher is 50 or greater, and the component ratio of the fraction in the whole fraction volume is 1 percent by volume or more and 50 percent by volume or less.

The present invention also provides the foregoing gas oil composition with quality items fulfilling the JIS Special No. 3 grade gas oil standards other than sulfur content for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 350° C. or lower in distillation characteristics, and the following characteristics (1) to (3) in each fraction range wherein:

(1) the cetane number in a fraction range of lower than 200° C. is 20 or greater and less than 40, and the component ratio of the fraction in the whole fraction volume is 40 percent by volume or more and 70 percent by volume or less;

(2) the cetane number in a fraction range of 200° C. or higher and lower than 280° C. is 30 or greater and less than 60, and the component ratio of the fraction in the whole fraction volume is 20 percent by volume or more and 59 percent by volume or less; and (3) the cetane number in a fraction range of 280° C. or higher is 50 or greater, and the component ratio of the fraction in the whole fraction volume is 1 percent by volume or more and 30 percent by volume or less.

The present invention also provides the foregoing gas oil composition wherein the peroxide number after an accelerated oxidation test is preferably 50 ppm by mass or less, the aromatic content is preferably 15 percent by volume or less and the blend ratio of the FT synthetic base oil is preferably 20 percent by volume or more.

What is intended by the present invention is to balance a relatively light fraction evaporating at a relatively earlier stage and a heavy fraction evaporating at a relatively later stage, considering not only ignition phenomenon but also evaporation and air mixing phenomenon occurring prior to the ignition phenomenon. Whereby, the present invention can assist optimum ignition conditions in homogenous charge compression ignition combustion and the conventional diesel combustion. Since these ignition phenomena highly depend on the compression ratio or intake conditions of an engine in which fuel is used, the present invention also imposed some restrictions on conditions of the engine so that the fuel can exhibit most excellent efficiencies.

[Effects of the Invention]

According to the present invention, the use of a gas oil composition produced by the above described process, with the above-described requirements regarding fractions renders it possible to produce a high quality fuel that can achieve at a high level both an excellent practical performance under conditions in a summer or winter season and environment friendly properties that can be applied to homogenous charge compression ignition combustion, both of which performance and properties have been difficult to achieve with the conventional fuel composition.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 1 is a schematic structural view illustrating an example of a device used for measuring the bulk modulus of a gas oil composition.

DESCRIPTION OF NUMERALS

1 fixed-volume container
2 supplying valve
3 exhaust valve
4 temperature sensor
5 pressure sensor
6 piston
100 gas oil composition

DETAILED DESCRIPTION OF THE INVENTION

The present invention will be described in more detail below.

The gas oil composition of the present invention necessarily contains an FT synthetic base oil. The FT synthetic base oil is composed of saturated hydrocarbon compounds, and the gas oil composition of the present invention can be easily produced by adjusting the blend of the hydrocarbon compounds. There is no particular restriction on the characteristics of the FT synthetic base oil as long as the characteristics of the gas oil composition of the present invention are satisfied. There is no particular restriction on base oils other than the FT synthetic base oil as long as the characteristics of the gas oil composition of the present invention are fulfilled. However, in order to allow the composition to exhibit sufficient environment friendly properties, it is preferable to blend the following petroleum base oil having been highly hydrotreated and animal- or vegetable-derived processed oils.

The FT synthetic base oil referred herein denotes various synthetic oils such as liquid fractions corresponding to naphtha, kerosene and gas oil, produced by subjecting a mixed gas containing mainly hydrogen and carbon monoxide (hereinafter may be often referred to as "synthetic gas") to a Fischer-Tropsch (FT) reaction; hydrocarbon mixtures produced by hydrorefining or hydrocracking such liquid fractions; and hydrocarbon mixtures produced by hydrorefining or hydrocracking liquid fractions and FT wax produced through a Fischer-Tropsch reaction.

The gas oil composition comprises preferably 20 percent by volume or more of the FT synthetic base oil. Further, the composition comprises more preferably 25 percent by volume or more, more preferably 30 percent by volume or more, more preferably 35 percent by volume or more of the FT synthetic base oil with the objective of lessening the occasion to increase the burden to the environment caused by sulfur components or aromatic components and carrying out more efficiently the adjustment of ignition required for homogenous charge compression ignition combustion.

There is no particular restriction on the characteristics of the FT synthetic base oil as long as the resulting gas oil composition will have the predetermined characteristics However, it is preferable to blend an FT synthetic base oil with a boiling point range of 140 to 380° C. in view of easy production of the gas oil composition of the present invention.

The mixed gas which will be the feedstock of the FT synthetic oil is produced by oxidizing a substance containing carbon using oxygen and/or water and/or carbon dioxide as an oxidizing agent and further if necessary by a shift reaction using water so as to be adjusted in predetermined hydrogen and carbon monoxide concentrations.

Substances containing carbon which may be used herein are generally gas components composed of hydrocarbons that are gas in normal temperatures such as natural gas, liquefied petroleum gas, and methane gas, petroleum asphalt, biomass, coke, wastes such as building materials and garbage, sludge, heavy crude oils that are difficult to be disposed in the usual manner, and mixed gas produced by exposing unconventional petroleum resources to elevated temperatures. However, in the present invention, there is no particular restriction on the feedstock as long as a mixed gas containing mainly hydrogen and carbon monoxide can be produced.

The Fischer-Tropsch reaction requires a metal catalyst. It is preferable to use metals in Group 8 of the periodic table, such as cobalt, ruthenium, rhodium, palladium, nickel and iron, more preferably metals in Group 8, Period 4, as an active catalyst component. Alternatively, there may be used a mixed metal group containing these metals in suitable amounts. These active metals are generally used in the form of a catalyst produced by supporting them on a support such as alumina, titania and silica-alumina. Alternatively, the use of the forgoing active metals in combination with a second metal can improve the performances of the resulting catalyst. Examples of the second metal include alkali or alkaline earth metals such as sodium, lithium and magnesium, zirconium, hafnium and titanium, which will be used depending on purposes such as increase in conversion rate of carbon monoxide or chain growth probability (α) which is an index of the production amount of wax.

The Fischer-Tropsch reaction is a synthetic method for producing liquid fractions and FT wax using a mixed gas as the feedstock. It is generally preferable to adjust the ratio of hydrogen to carbon monoxide in the mixed gas in order to carry out the synthetic method efficiently. In general, the molar mix ratio of hydrogen to carbon monoxide (hydrogen/carbon monoxide) is preferably 1.2 or greater, more preferably 1.5 or greater, more preferably 1.8 or greater. The ratio is also preferably 3 or less, more preferably 2.6 or less, more preferably 2.2 or less.

The reaction temperature at which the Fischer-Tropsch reaction is carried out using the foregoing catalyst is preferably 180° C. or higher and 320° C. or lower, more preferably 200° C. or higher and 300° C. or lower. At a reaction temperature of lower than 180° C., carbon monoxide hardly reacts, resulting in a tendency that the hydrocarbon yield is reduced. At a reaction temperature of higher than 320° C., gas such as methane is increasingly formed, resulting in a reduction in the production efficiency of liquid fractions and FT wax.

There is no particular restriction on the gas hourly space velocity with respect to the catalyst. However, it is preferably 500 $h^{-1}$ or more and 4000 $h^{-1}$ or lower, more preferably 1000 $h^{-1}$ or more and 3000 $h^{-1}$ or lower. A gas hourly space velocity of less than 500 $h^{-1}$ is likely to reduce the production of the liquid fuel while a gas hourly space velocity of more than 400 $h^{-1}$ causes a necessity to increase the reaction temperature and increase the amount of gas to be produced, resulting in a reduction in the yield of the intended product.

There is no particular restriction on the reaction pressure (partial pressure of a synthetic gas composed of carbon monoxide and hydrogen). However, it is preferably 0.5 MPa or greater and 7 MPa or smaller, more preferably 2 MPa or greater and 4 MPa or smaller. If the reaction pressure is smaller than 0.5 MPa, the yield of liquid fuel would tend to decrease. If the reaction pressure is greater than 7 MPa, it is not economically advantageous because the amount of capital investment in facilities would be increased.

If necessary, liquid fractions and FT wax produced through the above-described FT reaction may be hydrorefined or hydrocracked in any suitable manner so as to be adjusted in distillation characteristics or composition to achieve the purposes of the invention. Hydrorefining or hydrocracking may be selected depending on the purposes and the present invention is not limited in selection to either one or both of them to such an extent that the gas oil composition of the present invention is produced.

Catalysts used for hydrorefining are generally those comprising a hydrogenation active metal supported on a porous support, but the present invention is not limited thereto as long as the same effects are obtained.

The porous support is preferably an inorganic oxide. Specific examples include alumina, titania, zirconia, boria, silica, zeolite and the like.

Zeolite is crystalline aluminosilicate, examples of which include faujasite, pentasil and mordenite type zeolites. Preferred are faujasite, beta and mordenite type zeolites and particularly preferred are Y-type and beta-type zeolites. Y-type zeolites are preferably ultra stable.

Preferred for the active metal are those of the following two types (active metal A type and active metal B type).

The active metal A type is at least one type of metal selected from the group consisting of those in Group 8 of the periodic table. It is preferably at least one type selected from the group consisting of Ru, Rh, Ir, Pd and Pt, and is more preferably Pd and/or Pt. The active metal may be a combination of these metals, such as Pt—Pd, Pt—Rh, Pt—Ru, Ir—Pd, Ir—Rh, Ir—Ru, Pt—Pd—Rh, Pt—Rh—Ru, Ir—Pd—Rh, and Ir—Rh—Ru. A noble metal catalyst formed of these metals can be used after being subjected to a pre-reduction treatment under hydrogen flow. In general, the catalyst is heated at a temperature of 200° C. or higher in accordance with predetermined procedures, circulating a gas containing hydrogen so that the active metal on the catalyst is reduced and thus exhibits hydrogenation activity.

The active metal B type contains preferably at least one type of metal selected from the group consisting of those in Groups 6A and 8 of the periodic table, desirously two or more types of metals selected therefrom. Examples of these metals include Co—Mo, Ni—Mo, Ni—Co—Mo and Ni—W. When a metal sulfide catalyst formed of these metals is used, it must undergo a pre-sulfurization process.

The metal source may be a conventional inorganic salt or complex salt compound. The supporting method may be any supporting method that has been usually used for hydrogenation catalysts, such as impregnation and ion-exchange methods. When a plurality of metals are supported, they may be supported simultaneously using a mixed solution thereof or sequentially using a single solution containing each metal. The metal solution may be an aqueous solution or a solution using an organic solvent.

The reaction temperature at which hydrorefining is carried out using a catalyst composed of the active metal A type is preferably 180° C. or higher and 400° C. or lower, more preferably 200° C. or higher and 370° C. or lower, more preferably 250° C. or higher and 350° C. or lower, more preferably 280° C. or higher and 350° C. or lower. A reaction temperature of higher than 370° C. is not preferable because the yield of the middle fraction is extremely reduced, resulting from an increase in a side reaction wherein the liquid fraction or FT wax is cracked to a naphtha fraction. A reaction temperature of lower than 270° C. is not also preferable because alcohols can not be removed and thus remains in the reaction system.

The reaction temperature at which hydrorefining is carried out using a catalyst composed of the active metal B type is preferably 170° C. or higher and 320° C. or lower, more preferably 175° C. or higher and 300° C. or lower, more preferably 180° C. or higher and 280° C. or lower. A reaction temperature of higher than 320° C. is not preferable because the yield of the middle fraction is reduced, resulting from an increase in a side reaction wherein the liquid fraction or FT wax is cracked to a naphtha fraction. A reaction temperature of lower than 170° C. is not also preferable because alcohols can not be removed and thus remains in the reaction system.

The hydrogen pressure at which hydrorefining is carried out using a catalyst composed of the active metal A type is preferably 0.5 MPa or greater and 12 MPa or less, more preferably 1.0 MPa or greater and 5.0 MPa or less. Although a higher hydrogen pressure facilitates the hydrogenation reaction, there is generally an optimum point in economical sense.

The hydrogen pressure at which hydrorefining is carried out using a catalyst composed of the active metal B type is preferably 2 MPa or greater and 10 MPa or less, more preferably 2.5 MPa or greater and 8 MPa or less, more preferably 3 MPa or greater and 7 MPa or less. Although a higher hydrogen pressure facilitates the hydrogenation reaction, there is generally an optimum point in economical sense.

The liquid hourly space velocity (LHSV) at which hydrorefining is carried out using a catalyst composed of the active metal A type is preferably 0.1 $h^{-1}$ or greater and 10.0 $h^{-1}$ or less, more preferably 0.3 $h^{-1}$ or greater and 3.5 $h^{-1}$ or less. Although a lower LHSV is advantageous for the reaction, a too low LHSV is not economically preferable because it requires an extremely large reactor volume, leading to an excessive capital investment in facilities.

The liquid hourly space velocity (LHSV) at which hydrorefining is carried out using a catalyst composed of the active metal B type is preferably 0.1 $h^{-1}$ or greater and 2 $h^{-1}$ or less, more preferably 0.2 $h^{-1}$ or greater and 1.5 $h^{-1}$ or less, more preferably 0.3 $h^{-1}$ or greater and 1.2 $h^{-1}$ or less. Although a lower LHSV is advantageous for the reaction, a too low LHSV is not economically preferable because it requires an extremely large reactor volume, leading to an excessive capital investment in facilities.

The hydrogen/oil ratio at which hydrorefining is carried out using a catalyst composed of the active metal A type is preferably 50 NL/L or greater and 1000 NL/L or less, more preferably 70 NL/L or greater and 800 NL/L or less. Although a higher hydrogen/oil ratio facilitates the reaction, there is generally an optimum point in economical sense.

The hydrogen/oil ratio at which hydrorefining is carried out using a catalyst composed of the active metal B type is preferably 100 NL/L or greater and 800 NL/L or less, more preferably 120 NL/L or greater and 600 NL/L or less, more preferably 150 NL/L or greater and 500 NL/L or less. Although a higher hydrogen/oil ratio facilitates the reaction, there is generally an optimum point in economical sense.

Catalysts used for hydrocracking are generally those comprising a hydrogenation active metal supported on a support with solid acidic properties, but the present invention is not limited thereto as long as the same effects are obtained.

As for the support with solid acidic properties, there are amorphous and crystalline zeolite types. Specific examples include silica-alumina, silica-magnesia, silica-zirconia and silica-titania, which are of amorphous type and zeolites of faujasite, beta, MFI and mordenite types, preferably Y type and beta type. The Y type zeolites are preferably those that are ultra stable.

Preferred for the active metal are those of the following two types (active metal A type and active metal B type).

The active metal A type is at least one type of metal mainly selected from the group consisting of those in Groups 6A and 8 of the periodic table. It is preferably at least one type of metal selected from the group consisting of Ni, Co, Mo, Pt, Pd and W. A noble metal catalyst formed of these metals can be used after being subjected to a pre-reduction treatment under hydrogen flow. In general, the catalyst is heated at a temperature of 200° C. or higher in accordance with predetermined procedures, circulating a gas containing hydrogen so that the active metal on the catalyst is reduced and thus exhibits hydrogenation activity.

The active metal B type may be a combination of these metals, such as Pt—Pd, Co—Mo, Ni—Mo, Ni—W, and Ni—Co—Mo. When a catalyst formed of these metals is used, it must undergo a pre-sulfurization process before use.

The metal source may be a conventional inorganic salt or complex salt compound. The supporting method may be any supporting method that has been usually used for hydrogenation catalysts, such as impregnation and ion-exchange methods. When a plurality of metals are supported, they may be supported simultaneously using a mixed solution thereof or sequentially using a single solution containing each metal. The metal solution may be an aqueous solution or a solution with an organic solvent.

The reaction temperature at which hydrocracking is carried out using a catalyst composed of the active metal type A and active metal type B is preferably 200° C. or higher and 450° C. or lower, more preferably 250° C. or higher and 430° C. or lower, more preferably 300° C. or higher and 400° C. or lower. A reaction temperature of higher than 450° C. is not preferable because the yield of the middle fraction is extremely reduced, resulting from an increase in a side reaction wherein the liquid fraction or FT wax is cracked to a naphtha fraction. A reaction temperature of lower than 200° C. is not also preferable because the activity of the catalyst is extremely reduced.

The hydrogen pressure at which hydrocracking is carried out using a catalyst composed of the active metal type A and active metal type B is preferably 1 MPa or greater and 20 MPa or less, more preferably 4 MPa or greater and 16 MPa or less, more preferably 6 MPa or greater and 13 MPa or less. Although a higher hydrogen pressure facilitates the hydrogenation reaction, the cracking reaction would rather proceed slowly and thus needs to be adjusted in the proceeding thereof by increasing the reaction temperature, leading to a short working life of the catalyst. Therefore, there is generally an optimum point in economical sense.

The liquid hourly space velocity (LHSV) at which hydrocracking is carried out using a catalyst composed of the active metal A type is preferably 0.1 $h^{-1}$ or greater and 10.0 $h^{-1}$ or less, more preferably 0.3 $h^{-1}$ or greater and 3.5 $h^{-1}$ or less. Although a lower LHSV is advantageous for the reaction, a too low LHSV is not economically preferable because it requires an extremely large reactor volume, leading to an excessive capital investment in facilities.

The liquid hourly space velocity (LHSV) at which hydrocracking is carried out using a catalyst composed of the active metal B type is preferably 0.1 $h^{-1}$ or greater and 2 $h^{-1}$ or less, more preferably 0.2 $h^{-1}$ or greater and 1.7 $h^{-1}$ or less, more preferably 0.3 $h^{-1}$ or greater and 1.5 $h^{-1}$ or less. Although a lower LHSV is advantageous for the reaction, a too low LHSV is not economically preferable because it requires an extremely large reactor volume, leading to an excessive capital investment in facilities.

The hydrogen/oil ratio at which hydrocracking is carried out using a catalyst composed of the active metal A type is preferably 50 NL/L or greater and 1000 NL/L or less, more preferably 70 NL/L or greater and 800 NL/L or less, more preferably 400 NL/L or greater and 1500 NL/L or less. Although a higher hydrogen/oil ratio facilitates the reaction, there is generally an optimum point in economical sense.

The hydrogen/oil ratio at which hydrocracking is carried out using a catalyst composed of the active metal B type is preferably 150 NL/L or greater and 2000 NL/L or less, more preferably 300 NL/L or greater and 1700 NL/L or less, more preferably 400 NL/L or greater and 1500 NL/L or less. Although a higher hydrogen/oil ratio facilitates the reaction, there is generally an optimum point in economical sense.

The reactor for hydrogenation may be of any structure and a single or a plurality of reaction tower may be used. Hydrogen may be additionally supplied between a plurality of reaction towers. The reactor may have a facility for removing sulfurized hydrogen and a distillation tower for fractionally distilling hydrogenated products for producing desired fractions.

The reaction mode of the hydrogenation reactor may be a fixed bed mode. Hydrogen may be supplied to the feedstock in a counter or parallel flow mode. Alternatively, the reaction mode may be a combination of counter and parallel flow modes, with a plurality of reaction towers. The supply mode of the feedstock is generally down flow and is preferably a gas-liquid cocurrent flow mode. Hydrogen gas may be supplied as quencher into a middle portion of a reactor for the purposes of removing the reaction heat or increasing the hydrogen partial pressure. The mixed gas which will be the feedstock of the FT synthetic oil is produced by oxidizing a substance containing carbon using oxygen and/or water and/or carbon dioxide and further if necessary by a shift reaction using water so as to be adjusted in predetermined hydrogen and carbon monoxide concentrations. Substances containing carbon which may be used herein are generally gas components composed of hydrocarbons that are gas in normal temperatures such as natural gas, liquefied petroleum gas, and methane gas, petroleum asphalt, biomass, coke, wastes such as building materials and garbage, sludge, heavy crude oils that are difficult to be disposed in the usual manner, and mixed gas produced by exposing unconventional petroleum resources to elevated temperatures. However, in the present invention, there is no particular restriction on the feedstock as long as a mixed gas containing mainly hydrogen and carbon monoxide can be produced.

The above-mentioned petroleum-based base oil is a hydrocarbon base oil produced by processing crude oil. Examples include straight base oils produced through an atmospheric distillation unit; vacuum base oils produced by processing straight heavy oil or residue produced through an atmospheric distillation unit, in a vacuum distillation unit; catalytically cracked or hydrocracked base oils produced by catalytically cracking or hydrocracking vacuum heavy base oil or desulfurized fuel oil; and hydrorefined or hydrodesulfurized base oils produced by hydrorefining any of these petroleum hydrocarbons. Alternatively, other than crude oil, base oils produced by subjecting to resources referred to as unconventional petroleum resources, such as oil shale, oil sand and Orinoco tar to suitable processing to have properties equivalent to those of the foregoing base oils may be used as the base oil in the present invention.

The above-mentioned highly hydrogenated petroleum-based base oil is a kerosene or gas oil fraction produced by hydrorefining and then hydrotreating a predetermined feedstock. Examples of the feedstock include straight kerosene or gas oils produced through an atmospheric distillation unit for crude oil; vacuum kerosene or gas oils produced by processing straight heavy oil or residue produced through an atmospheric distillation unit, in a vacuum distillation unit; and hydrorefined and hydrodesulfurized kerosene or gas oils produced by hydrotreating catalytically cracked kerosene or gas oils produced by catalytically cracking desulfurized or undesulfurized vacuum kerosene or gas oils, vacuum heavy gas oil or desulfurized fuel oil.

When the feedstock is a gas oil fraction, conditions for hydrorefining may be those determined when a hydrodesulfurizing unit is generally used for petroleum refining. Generally, hydrorefining of a gas oil fraction is carried out under conditions where the reaction temperature is from 300 to 380° C., the hydrogen pressure is from 3 to 8 MPa, the LHSV is from 0.3 to 2 $h^{-1}$, and the hydrogen/oil ratio is from 100 to 500 NL/L. When the feedstock is a kerosene fraction, conditions for hydrorefining may be those determined when a hydrodesulfurizing unit is generally used for petroleum refining. Generally, hydrorefining of a kerosene fraction is carried out under conditions where the reaction temperature is from 220 to 350° C., the hydrogen pressure is from 1 to 6 MPa, the LHSV is from 0.1 to 10 $h^{-1}$, and the hydrogen/oil ratio is from 10 to 300 NL/L, preferably conditions where the reaction temperature is from 250 to 340° C., the hydrogen pressure is from 2 to 5 MPa, the LHSV is from 1 to 10 $h^{-1}$, and the hydrogen/oil ratio is from 30 to 200 NL/L, more preferably under conditions where the reaction temperature is from 270 to 330° C., the hydrogen pressure is from 2 to 4 MPa, the LHSV is from 2 to 10 $h^{-1}$, and the hydrogen/oil ratio is from 50 to 200 NL/L.

A lower reaction temperature is advantageous for hydrogenation reaction but is not preferable for desulfurization reaction. A higher hydrogen pressure and a higher hydrogen/oil ratio facilitate desulfurization and hydrogenation reactions but there is an optimum point in economical sense. Although a lower LHSV is advantageous for the reaction, a too low LHSV is not economically preferable because it requires an extremely large reactor volume, leading to an excessive capital investment in facilities.

A catalyst used for the hydrorefining may be any of the conventional hydrodesulfurization catalysts. Preferably, the active metals of the catalyst are the Groups 6A and 8 metals of the periodic table. Examples of these metals include Co—Mo, Ni—Mo, Co—W, and Ni—W. The support may be an porous inorganic oxide containing alumina as the main component. These conditions and the catalyst are not particularly restricted as long as the characteristics of the feedstock are satisfied.

The feedstock used in the present invention is produced through the above-described hydrorefining process and has preferably a sulfur content of 5 ppm by mass or more and 10 ppm by mass or less and a boiling point of 130° C. or higher and 380° C. or lower. The feed stock having a sulfur content and a boiling point within these ranges can ensure the easy achievement of the characteristics defined for the following high hydrogenation process.

The highly hydrotreated base oil is produced by hydrotreating the above-described hydrogenated kerosene or gas oil as the feedstock in the presence of a hydrogenation catalyst.

Conditions for the highly hydrogenation are those where the reaction temperature is from 170 to 320° C., the hydrogen pressure is from 2 to 10 MPa, the LHSV is from 0.1 to 2 $h^{-1}$, and the hydrogen/oil ratio is from 100 to 800 NL/L, preferably conditions where the reaction temperature is from 175 to 300° C., the hydrogen pressure is from 2.5 to 8 MPa, the LHSV is from 0.2 to 1.5 $h^{-1}$, and the hydrogen/oil ratio is from 150 to 600 NL/L, more preferably under conditions where the reaction temperature is from 180 to 280° C., the hydrogen pressure is from 3 to 7 MPa, the LHSV is from 0.3 to 1.2 $h^{-1}$, and the hydrogen/oil ratio is from 150 to 500 NL/L. A lower reaction temperature is advantageous for hydrogenation reaction but is not preferable for desulfurization reaction. A higher hydrogen pressure and a higher hydrogen/oil ratio facilitate desulfurization and hydrogenation reactions but there is an optimum point in economical sense. Although a lower LHSV is advantageous for the reaction, a too low LHSV is not economically preferable because it requires an extremely large reactor volume, leading to an excessive capital investment in facilities.

A unit for hydrotreating the feedstock having been hydrorefined may be of any structure, and a single or a plurality of reactors in combination may be used. Hydrogen may be additionally introduced into the spaces between a plurality of reactors. The hydrorefining unit may be provided with a gas-liquid separation system or a hydrogen sulfide removal system.

The reaction mode of the hydrogenation reactor may be a fixed bed mode. Hydrogen may be supplied to the feedstock in a counter or parallel flow mode. Alternatively, the reaction mode may be a combination of counter and parallel flow modes, with a plurality of reaction towers. The supply mode of the feedstock is generally down flow and is preferably a gas-liquid cocurrent flow mode. Hydrogen gas may be supplied as quencher into a middle portion of a reactor for the purposes of removing the reaction heat or increasing the hydrogen partial pressure.

A catalyst used for hydrotreating comprises a hydrogenation active metal supported on a porous support. The porous support may be an inorganic oxide such as alumina. Examples of the inorganic oxide include alumina, titania, zirconia, boria, silica, and zeolite. In the present invention, the support is preferably composed of alumina and at least one selected from titania, zirconia, boria, silica, and zeolite. There is no particular restriction on the method of producing the support. Therefore, there may be employed any method using raw materials in the form of sols or salt compounds each containing any of the elements. Alternatively, the support may be prepared by forming a complex hydroxide or oxide such as silica alumina, silica zirconia, alumina titania, silica titania, and alumina boria and then adding at any step alumina in the form of alumina gel, a hydroxide, or a suitable solution. Alumina can be contained in any ratio to the other oxides on the basis of the porous support. However, the content of alumina is preferably 90 percent by mass or less, more preferably 60 percent by mass or less, and more preferably 40 percent by mass or less, of the mass of the porous support.

Zeolite is a crystalline alumino silicate. Examples of the crystalline structure include faujasite, pentasil, and mordenite. These zeolites may be those ultra-stabilized by a specific hydrothermal treatment and/or acid treatment or those whose alumina content is adjusted. Preferred zeolites are those of faujasite, beta and mordenite types, and particularly preferred zeolites are those of Y and beta types. The zeolites of Y type are preferably ultra-stabilized. The ultra-stabilized zeolite have a micro porous structure peculiar thereto, so-called micro pores of 20 Å or smaller and also newly formed pores in the range of 20 to 100 Å. The hydrothermal treatment may be carried out under known conditions.

The active metal of the catalyst used for hydrotreating is at least one metal selected from the Group 8 metals of the periodic table, preferably at least one metal selected from Ru, Rh, Ir, Pd, and Pt, and more preferably Pd and/or Pt. These metals may be used in combination such as Pt—Pd, Pt—Rh, Pt—Ru, Ir—Pd, Ir—Rh, Ir—Ru, Pt—Pd—Rh, Pt—Rh—Ru, Ir—Pd—Rh, and Ir—Rh—Ru. The metal sources of these metals may be inorganic salts or complex salt compounds which have been conventionally used. The method of supporting the metal may be any of methods such as immersion and ion exchange which are used for a hydrogenation catalyst. When a plurality of metals are supported, they may be supported using a mixed solution thereof at the same time. Alternatively, a plurality of metals may be supported using solutions each containing any of the metals one after another. These metal solutions may be aqueous solutions or those produced using an organic solvent.

The metal(s) may be supported on the porous support after completion of all the steps for preparing the porous support. Alternatively, the metal(s) may be supported on the porous support in the form of a suitable oxide, complex oxide or zeolite produced at the intermediate stage of the preparation of the porous support and then may proceed to gel-preparation or be subjected to heat-concentration and kneading.

There is no particular restriction on the amount of the active metal(s) to be supported. However, the amount is from 0.1 to 10 percent by mass, preferably from 0.15 to 5 percent by mass, and more preferably from 0.2 to 3 percent by mass on the basis of the catalyst mass.

The catalyst is preferably used after it is subjected to a pre-reduction treatment under a hydrogen stream. In general, the active metal(s) are subjected to heat at 200° C. or higher in accordance with the predetermined procedures, circulating gas containing hydrogen and then reduced, thereby exerting catalytic activity.

The animal- or vegetable-derived processed oils referred above are base oils composed of hydrocarbons produced by applying chemical reaction processes applied to produce the above-described petroleum-based base oils, to oils or fats yielded or produced animal or vegetable raw materials. More specifically, the animal- or vegetable-derived processed oils are hydrocarbon-containing mixed base oils produced by contacting an animal or vegetable fat and a component derived therefrom used as a feedstock with a hydrocracking catalyst containing at least one or more metals selected from the Groups 6A and 8 metals of the periodic table and an inorganic oxide with acidic properties, under hydrogen pressure. The feedstock of the animal- or vegetable-derived processed oil is necessarily an animal or vegetable fat or a component derived therefrom. Examples of the animal or vegetable fat or the component originating therefrom used herein include natural or artificially made or produced animal or vegetable fats and animal or vegetable fat components originating therefrom. Examples of raw materials of the animal fats and animal oils include beef tallow, milk fat (butter), lard, mutton tallow, whale oil, fish oil, and liver oil. Examples of raw materials of the vegetable fats and vegetable oils include the seeds and other parts of coconut, palm tree, olive, safflower, rape (rape blossoms), rice bran, sunflower, cotton seed, corn, soy bean, sesame, and flaxseed. Fats or oils other than those produced from these materials may also be used in the present invention. The feedstocks may be of solid or liquid but are preferably produced from vegetable fats or vegetable oils with the objective of easy handling, carbon dioxide absorptivity, and high productivity. Alternatively, waste oils resulting from the use of these animal and vegetable oils for household, industry and food preparation purposes may be used as the feedstock after the residual matters are removed from these oils.

Examples of the typical composition of the fatty acid part of the glyceride compounds contained in these feedstocks include fatty acids, so-called saturated fatty acids having no unsaturated bond in the molecules, such as butyric acid ($C_3H_7COOH$), caproic acid ($C_5H_{11}COOH$), caprylic acid ($C_7H_{15}COOH$), capric acid ($C_9H_{19}COOH$), lauric acid ($C_{11}H_{23}COOH$), myristic acid ($C_{13}H_{27}COOH$), palmitic acid ($C_{15}H_{31}COOH$), stearic acid ($C_{17}H_{35}COOH$), and so-called unsaturated fatty acids having one or more unsaturated bonds in the molecules, such as oleic acid ($C_{17}H_{33}COOH$), linoleic acid ($C_{17}H_{31}COOH$), linolenic acid ($C_{17}H_{29}COOH$) and ricinoleic acid ($C_{17}H_{32}(OH)COOH$). In general, the hydrocarbon parts of these fatty acids contained in substances existing in nature are mostly of straight chain. However, the fatty acid may be any of those having a side chain structure, i.e., isomers as long as the properties defined by the present invention are satisfied. The unsaturated fatty acid may be any of those existence of which are generally recognized in nature as well as those having an unsaturated bond per molecule, the position of which is adjusted through chemical synthesis as long as the properties defined by the present invention are satisfied.

The above-described feedstocks (animal or vegetable fats and components derived therefrom) contain one or more of these fatty acids, which vary depending on the raw materials. For example, coconuts oil contains a relatively large amount of saturated fatty acids such as lauric acid and myristic acid while soy bean oil contains a large amount of unsaturated fatty acids such as oleic acid and linoleic acid.

The feedstock contains a fraction whose boiling point is preferably 250° C. or higher, more preferably a fraction whose boiling point is 300° C. or higher, and more preferably a fraction whose boiling point is 360° C. or higher. If the feedstock contains no fraction whose boiling point is 230° C. or higher, the yield of a liquid product would be decreased due to an increase in gas formed during the production, possibly resulting in an increase in life cycle carbon dioxide.

Alternatively, the feedstock of the animal or vegetable-derived processed oil may be a mixture of an animal or vegetable fat and a component derived therefrom, with a petroleum hydrocarbon fraction. In this case, the ratio of the petroleum hydrocarbon fraction is preferably from 10 to 99 percent by volume, more preferably from 30 to 99 percent by volume, and more preferably from 60 to 98 percent by volume, of the total volume of the feedstock. If the ratio is less than the lower limit, there may arise the necessity of facilities for disposal of by-produced water. If the ratio exceeds the upper limit, it is not preferable in view of life cycle carbon dioxide reduction.

Conditions of hydrocracking the feedstock during the hydrotreating are those desirously wherein the hydrogen pressure is from 6 to 20 MPa, the liquid hourly space velocity (LHSV) is from 0.1 to 1.5 $h^{-1}$, and the hydrogen/oil ratio is from 200 to 2000 NL/L, more desirously wherein the hydrogen pressure is from 8 to 17 MPa, the liquid hourly space velocity (LHSV) is from 0.2 to 1.1 $h^{-1}$, and the hydrogen/oil ratio is from 300 to 1800 NL/L, more desirously wherein the hydrogen pressure is from 10 to 16 MPa, the liquid hourly space velocity (LHSV) is from 0.3 to 0.9 $h^{-1}$, and the hydrogen/oil ratio is from 350 to 1600 NL/L. Each of the conditions is a factor exerting an influence on the reaction activity. For example, if the hydrogen pressure and hydrogen/oil ratio are less than the lower limits, the reactivity tends to reduce, and the activity tends to reduce rapidly. If the hydrogen pressure and hydrogen/oil ratio exceed the upper limits, an enormous plant investment for a compressor may be required. A lower liquid hourly space velocity tends to be more advantageous for the reactions. However, if the liquid hourly space velocity is lower than 0.1 $h^{-1}$, an enormous plant investment for construction of a reactor with an extremely large volume may be required. If the liquid hourly space velocity exceeds 1.5 $h^{-1}$, the reaction tends to proceed insufficiently.

The gas oil composition of the present invention is a fuel used for a diesel engine with a geometric compression ratio of greater than 16, equipped with a supercharger and an EGR and necessarily comprises an FT synthetic base oil to have the characteristics described below.

The gas oil composition of the present invention is necessarily used for a diesel engine with a geometric compression ratio of greater than 16, equipped with a supercharger and an EGR. It is possible to use the gas oil composition for a diesel engine with a geometric compression ratio of 16 or less, equipped with no supercharger or EGR. However, the use of the gas oil composition for such a diesel engine is not preferable because the purpose of the present invention, i.e., the effect of reducing the burden to the environment can not be expected.

The geometric compression ratio is a compression ratio calculated from the physical specification of an engine. In general, it denotes a value obtained by dividing the cylinder inner volume A defined when the piston is at the lowermost position by the cylinder inner volume B defined when the piston is at the uppermost position, and the values of many diesel engines are usually on the order of from 12 to 22. In current electronic controlled diesel engines, the substantial compression ratio can be changed with intake and exhaust valves or by controlling the boost pressure. However, in the present invention, the scope of application thereof is defined with the geometric compression ratio, considering the influence of the substantial compression ratio.

Diesel engines for which the gas oil composition of the present invention is intended to be used are necessarily equipped with a supercharger and a device for EGR (exhaust gas recirculation). These devices are used for improving the exhaust gas properties, fuel consumption and output properties. In homogeneous charge compression ignition combustion in particular, they are frequently used for the purpose of controlling ignition, and the gas oil composition of the present invention is designed on the assumption that it is used for the purposes.

The present invention imposes no particular restriction to the other specification, usage or environment of use of the diesel engine for which the gas oil composition is used.

The gas oil composition of the present invention is a gas oil composition for use in a diesel engine with a geometric compression ratio of greater than 16, equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 380° C. or lower in distillation characteristics, and the following characteristics (1) to (3) in each fraction range wherein:

(1) the cetane number in a fraction range of lower than 200° C. is 20 or greater and less than 40;

(2) the cetane number in a fraction range of 200° C. or higher and lower than 280° C. is 30 or greater and less than 60; and (3) the cetane number in a fraction range of 280° C. or higher is 50 or greater.

Alternatively, the gas oil composition of the present invention is a gas oil composition with quality items fulfilling the JIS No. 1 grade gas oil standards (hereinafter referred to as "gas oil composition (No. 1)") other than sulfur content for use in a diesel engine with a geometric compression ratio of greater than 16, equipped with a supercharger and an EGR, containing an FT synthetic base oil and having a sulfur content of 5 ppm by mass or less, an oxygen content of 100 ppm by mass or less, a volume modulus of 1250 MPa or greater and 1450 MPa or less, a saybolt color of +22 or greater, a lubricity of 400 μm or less, an initial boiling point of 140° C. or higher and an end point of 380° C. or lower in distillation characteristics, and the following characteristics (1) to (3) in each fraction range:

(1) the cetane number in a fraction range of lower than 200° C. is 20 or greater and less than 40, and the component ratio of the fraction in the whole fraction volume is 1 percent by volume or more and less than 10 percent by volume;

(2) the cetane number in a fraction range of 200° C. or higher and lower than 280° C. is 30 or greater and less than 60, and the component ratio of the fraction in the whole fraction volume is 40 percent by volume or more and 98 percent by volume or less; and (3) the cetane number in a fraction range of 280° C. or higher is 50 or greater, and the component ratio of the fraction in the whole fraction volume is 1 percent by volume or more and 59 percent by volume or less.

The JIS No. 1 gas oil standard is a standard satisfying the requirements for "Type No. 1" defined in JIS K 2204 "Gas Oil".

The gas oil composition of the present invention is a gas oil composition with quality items fulfilling the JIS No. 2 grade gas oil standards (hereinafter referred to as "gas oil composition (No. 2)") other than sulfur content for use in a diesel engine with a geometric compression ratio of greater than 16, equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 360° C. or lower in distillation characteristics, and the following characteristics (1) to (3) in each fraction range wherein:

(1) the cetane number in a fraction range of lower than 200° C. is 20 or greater and less than 40, and the component ratio of the fraction in the whole fraction volume is 10 percent by volume or more and less than 20 percent by volume;

(2) the cetane number in a fraction range of 200° C. or higher and lower than 280° C. is 30 or greater and less than 60, and the component ratio of the fraction in the whole fraction volume is 30 percent by volume or more and 89 percent by volume or less; and (3) the cetane number in a fraction range of 280° C. or higher is 50 or greater, and the component ratio of the fraction in the whole fraction volume is 1 percent by volume or more and 60 percent by volume or less.

The JIS No. 2 gas oil standard is a standard satisfying the requirements for "Type No. 2" defined in JIS K 2204 "Gas Oil".

The gas oil composition of the present invention is a gas oil composition with quality items fulfilling the JIS No. 3 grade gas oil standards (hereinafter referred to as "gas oil composition (No. 3)") other than sulfur content for use in a diesel engine with a geometric compression ratio of greater than 16, equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 360° C. or lower in distillation characteristics, and the following characteristics (1) to (3) in each fraction range wherein:

(1) the cetane number in a fraction range of lower than 200° C. is 20 or greater and less than 40, and the component ratio of the fraction in the whole fraction volume is 20 percent by volume or more and less than 40 percent by volume;

(2) the cetane number in a fraction range of 200° C. or higher and lower than 280° C. is 30 or greater and less than 60, and the component ratio of the fraction in the whole fraction volume is 30 percent by volume or more and 78 percent by volume or less; and (3) the cetane number in a fraction range of 280° C. or higher is 50 or greater, and the component ratio of the fraction in the whole fraction volume is 1 percent by volume or more and 50 percent by volume or less.

The JIS No. 3 gas oil standard is a standard satisfying the requirements for "Type No. 3" defined in JIS K 2204 "Gas Oil".

The gas oil composition of the present invention is a gas oil composition with quality items fulfilling the JIS Special No. 3 grade gas oil standards (hereinafter referred to as "gas oil composition (Special No. 3)") other than sulfur content for use in a diesel engine with a geometric compression ratio of greater than 16, equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a lubricity of 400 μm or less, an initial boiling point of 140° C. or higher and an end point of 350° C. or lower in distillation characteristics, and the following characteristics (1) to (3) in each fraction range:

(1) the cetane number in a fraction range of lower than 200° C. is 20 or greater and less than 40, and the component ratio of the fraction in the whole fraction volume is 40 percent by volume or more and 70 percent by volume or less;

(2) the cetane number in a fraction range of 200° C. or higher and lower than 280° C. is 30 or greater and less than 60, and the component ratio of the fraction in the whole fraction volume is 20 percent by volume or more and 59 percent by volume or less; and (3) the cetane number in a fraction range of 280° C. or higher is 50 or greater, and the component ratio of the fraction in the whole fraction volume is 1 percent by volume or more and 30 percent by volume or less.

The JIS Special No. 3 gas oil standard is a standard satisfying the requirements for "Type Special No. 3" defined in JIS K 2204 "Gas Oil".

The sulfur content of the gas oil composition of the present invention is necessarily 5 ppm by mass or less, preferably 3 ppm by mass or less, more preferably 1 ppm by mass or less, with the objective of reducing poisonous substances exhausted from an engine and improving exhaust-gas post-processing system performances. The sulfur content used herein denotes the mass content of the sulfur components on the basis of the total mass of a gas oil composition measured in accordance with JIS K 2541 "Crude oil and petroleum products-Determination of sulfur content".

The oxygen content of the gas oil compositions of the present invention is necessarily 100 ppm by mass or less, preferably 80 ppm by mass or less, more preferably 60 ppm by mass or less, with the objective of improving oxidation stability. The oxygen content can be measured with a conventional elemental analysis device. For example, the oxygen content is measured by converting a sample to CO or further to $CO_2$ on platinum carbon and measuring the amount thereof using a thermal conductivity detector.

The bulk modulus of the gas oil composition is necessarily 1250 MPa or greater and 1450 MPa or less. In general, when a high pressure is applied to a compressive fluid, such as gas oil, the fluid has behaviors that it is compressed depending on the surrounding temperature and pressure and the density (volume per volumetric flow) changes. This compressive modulus is defined as the bulk modulus (unit: MPa). When a diesel fuel is injected, the bulk modulus of the fuel fluid changes at a constant rate depending on the surrounding temperature and pressure as well as the physical properties and composition of the fuel. Therefore, for an injection system with injection properties that the injection is carried out under high pressure with a high degree of accuracy, such as electronically controlled fuel injection pumps, it is preferable to use a fuel which is stable in the numerical value of the bulk modulus so as to maintain the injection volume or rate predetermined for the system. Therefore, the bulk modulus of the gas oil composition of the present invention is necessarily 1250 MPa or greater and 1450 MPa or less, preferably 1270 MPa or greater and 1420 MPa or less, more preferably 1300 MPa or greater and 1400 MPa or less.

The bulk modulus is not a matter that can be determined with a single fuel physical property or composition and should be defined as the result of being integrally affected with a plurality of physical properties and composition. It is thus reasonable in the technical view point to consider that the bulk modulus is one of the fuel properties that should be defined, in view of other physical properties and compositions.

Although there has existed no officially established method for measuring the bulk modulus, the brief thereof will be given with reference to FIG. 1 annexed herewith. A fuel to be measured is filled into a fixed volume container formed from material and having a structure, for which material and structure it is possible to demonstrate that changes in the volume of the container itself, resulting from the surrounding temperature and pressure change is sufficiently smaller than changes in the volume of the fuel resulting from the same change in the surrounding. Thereupon, the container is necessarily filled up only with the fuel to be measured. Into the container is inserted a fixed volume piston formed from material and having a structure, for which material and structure it is possible to demonstrate that changes in the volume of the piston itself resulting from the surrounding temperature and pressure changes are sufficiently smaller than changes in the volume of the fuel, resulting from the same change in the surrounding, so as to change the volume of the container. The fuel to be measured is compressed in conformity with its compressive modulus properties, and as the result, the pressure in the container changes. The pressure is then measured to calculate the bulk modulus.

More detailed description will be given of a method for measuring the bulk modulus of a gas oil composition.

FIG. 1 is a schematic structural view illustrating an example of an apparatus for measuring the bulk modulus. In FIG. 1, a supply valve 2 is arranged on the upper surface of a fixed-volume container 1 to be in communication with the inside thereof, and an exhaust valve 3 is connected to the supply valve 2 at a certain position thereof. Further, a temperature sensor 4 and a pressure sensor 5, and a piston 6 are arranged on a side and the bottom of the container 1, respectively in communication with the interior thereof. The container 1 and piston 6 are each formed from a material and have a structure, with which material and structure the volume changes of the container and piston are sufficiently smaller than the volume change of the fuel when the surrounding temperature and pressure change in predetermined levels.

When the measuring apparatus shown in FIG. 1 is used, a gas oil composition 100 to be measured is firstly supplied through the supply valve 2 into the container until the container is filled up with the fuel. Next, the volume in the container is changed with the piston. Thereupon, the fuel is compressed in conformity with its compressive modulus properties, and as the result, the pressure inside the container 1 changes. The temperature and pressure in this compression process are measured with the temperature sensor 4 and pressure sensor 5, respectively. On the basis of the measured values, the bulk modulus can be calculated.

The saybolt color of the gas oil compositions of the present invention is necessarily +22 or greater, preferably +25 or greater, more preferably +27 or greater with the objective of removing substances inhibiting oxidation stability. The saybolt color referred herein denotes the value measured in accordance with JIS K 2580 "Petroleum product-color test method-saybolt color test method".

The gas oil compositions of the present invention have necessarily such a lubricating performance that the HFRR wear scar diameter (WS 1.4) is 400 μm or smaller. If the lubricating performance is too low, the composition would cause a diesel engine equipped with a distribution type injection pump in particular to be increased in driving torque and in wear on each part of the pump while the engine is driven, possibly leading not only to degradation of the exhaust gas properties but also to the breakdown of the engine itself. Also in an electronically controlled fuel injection pump enabling a high pressure injection, wear on the sliding parts would likely occur. Therefore, with respect to the lubricity, the HFRR wear scar diameter (WS 1.4) of the gas oil composition is necessarily 400 μm or smaller, preferably 380 μm or smaller, more preferably 360 μm or smaller.

The lubricity, i.e., HFRR wear scar diameter (WS 1.4) used herein denotes the lubricity measured in accordance with JPI-5S-50-98 "Gas oil-Testing Method for Lubricity" prescribed in JPI Standard and Manuals Testing Method for Petroleum Products published by Japan Petroleum Inst.

The gas oil composition of the present invention is necessarily restricted in the component ratio of each fraction and cetane number thereof. That is, the present invention makes it possible to produce gas oil compositions each fulfilling the JIS No. 1 grade gas oil standards, the JIS No. 2 grade gas oil standards, the JIS No. 3 grade gas oil standards and the JIS Special No. 3 grade gas oil standards, respectively by setting specific fractions of the gas oil composition to specific component ratios. The role of each fraction and restrictions imposed thereon will be set forth below.

The gas oil composition (No. 1) of the present invention is assumed to be used during a summer season and would be poor in high-temperature restartability if containing too much light fraction (fraction with distillation characteristics at lower than 200° C.). However, the composition would be poor in evaporation characteristics unless containing the light fraction in a certain amount. Further, if the light fraction which is likely to evaporate is too high in cetane number, the composition would cause unintentional self-ignition to start before being sufficiently mixed with air, resulting in a failure to achieve homogeneous charge compression ignition combustion. However, if the cetane number is too low, self-ignition is likely to delay extremely.

As the result of various studies in view of the foregoing tendency, it is necessary that the cetane number of the fraction with distillation characteristics at lower than 200° C. is 20 or greater and less than 40 and the component ratio of the fraction is 1 percent by volume or more and less than 10 percent by volume of the whole fraction volume of the composition. Further, the cetane number of the fraction is preferably 21 or greater and 39 or less, more preferably 22 or greater and 38 or less. The component ratio of the fraction is preferably 2 percent by volume or more and 9.5 percent by volume or less, more preferably 3 percent by volume or more and 9 percent by volume or less of the whole fraction volume.

The gas oil composition (No. 1) of the present invention is mainly composed of a middle fraction (fraction with distillation characteristics within the range of 200° C. or higher and lower than 280° C.). That is, it is necessary to restrict the amount of the light fraction to suppress deterioration of high-temperature restartability as described above and also to restrict the amount of the middle fraction to a suitable extent so as to maintain the evaporation characteristics. It is preferable to set the cetane number of the middle fraction slightly higher to allow the composition to self-ignite positively since the middle fraction is mainly involved with ignition.

As the result of various studies in view of the foregoing tendency, it is necessary that the cetane number of the middle fraction with distillation characteristics within the range of 200° C. or higher and lower than 280° C. is 30 or greater and less than 60 and the component ratio of the middle fraction is 40 percent by volume or more and less than 98 percent by volume of the whole fraction volume of the composition. Further, the cetane number of the middle fraction is preferably 31 or greater and 59 or less, more preferably 32 or greater and 58 or less. The component ratio of the fraction is preferably 42 percent by volume or more and 97 percent by volume or less, more preferably 45 percent by volume or more and 95 percent by volume or less of the whole fraction volume.

The heavy fraction (fraction with distillation characteristics at 280° C. or higher) of the gas oil composition (No. 1) of the present invention is large in calorific value per volume and thus important for improving the output and fuel consumption. However, this fraction would possibly produce soot if the combustion surrounding conditions (temperature, pressure and the ratio with air) are not suitable. It is necessary to determine the blend ratio of the heavy fraction considering the balance with the above-described light and middle fractions. The heavy fraction requires to take sufficient time to be mixed with air because it is slow in evaporation speed and thus can not be blended in a large amount. Therefore, the heavy fraction needs to be excellent in self-ignition properties.

As the result of various studies in view of the foregoing tendency, it is necessary that the cetane number of the heavy fraction with distillation characteristics at 280° C. or higher is 50 or greater and the component ratio of the heavy fraction is 1 percent by volume or more and 59 percent by volume or less of the whole fraction volume of the composition. Further, the cetane number of the heavy fraction is preferably 52 or greater, more preferably 54 or greater. The component ratio of the fraction is preferably 5 percent by volume or more and 55 percent by volume or less, more preferably 10 percent by volume or more and 50 percent by volume or less, more preferably 15 percent by volume or more and 45 percent by volume or less of the whole fraction volume.

The gas oil composition (No. 2) of the present invention is assumed to be used during a winter season and would be lowered in caloric value and thus poor in fuel consumption if containing too much light fraction (fraction with distillation characteristics at lower than 200° C.). However, the composition would be poor in evaporation characteristics unless containing the light fraction in a certain amount. Further, if the light fraction which is likely to evaporate is too high in cetane number, the composition would cause unintentional self-ignition to start before being sufficiently mixed with air, resulting in a failure to achieve homogeneous charge compression ignition combustion. However, if the cetane number is too low, self-ignition is likely to delay extremely.

As the result of various studies in view of the foregoing tendency, it is necessary that the cetane number of the fraction with distillation characteristics at lower than 200° C. is 20 or greater and less than 40 and the component ratio of the fraction is 10 percent by volume or more and less than 20 percent by volume of the whole fraction volume of the composition. Further, the cetane number of the fraction is preferably 21 or greater and 39 or less, more preferably 22 or greater and 38 or less. The component ratio of the fraction is preferably 11 percent by volume or more and 19.5 percent by volume or less, more preferably 12 percent by volume or more and 19 percent by volume or less of the whole fraction volume.

The gas oil composition (No. 2) of the present invention is mainly composed of a middle fraction (fraction with distillation characteristics within the range of 200° C. or higher and lower than 280° C.). That is, it is necessary to restrict the amount of the light fraction to suppress deterioration of fuel consumption as described above and also to restrict the amount of the middle fraction so as to maintain the evaporation characteristics. It is preferable to set the cetane number of the middle fraction slightly higher to allow the composition to self-ignite positively since the middle fraction is mainly involved with ignition.

As the result of various studies in view of the foregoing tendency, it is necessary that the cetane number of the middle fraction with distillation characteristics within the range of 200° C. or higher and lower than 280° C. is 30 or greater and less than 60 and the component ratio of the middle fraction is 30 percent by volume or more and less than 89 percent by volume of the whole fraction volume of the composition. Further, the cetane number of the middle fraction is preferably 31 or greater and 59 or less, more preferably 32 or greater and 58 or less. The component ratio of the fraction is preferably 32 percent by volume or more and 85 percent by volume or less, more preferably 35 percent by volume or more and 80 percent by volume or less of the whole fraction volume.

The heavy fraction (fraction with distillation characteristics at 280° C. or higher) of the gas oil composition (No. 2) of the present invention is large in calorific value per volume and thus important for improving output and fuel consumption. However, this fraction would possibly produce soot if the combustion surrounding conditions (temperature, pressure and ratio with air) are not suitable. Further, the gas oil composition (No. 2) of the present invention is assumed to be used during a winter season and would possibly be deteriorated in low-temperature flowability if containing too much heavy fraction. It is necessary to determine the blend ratio of the heavy fraction considering the balance with the above-described light and middle fractions. The heavy fraction requires to take sufficient time to be mixed with air because it is slow in evaporation speed and thus can not be blended in a large amount. Therefore, the heavy fraction needs to be excellent in self-ignition properties.

As the result of various studies in view of the foregoing tendency, it is necessary that the cetane number of the heavy fraction with distillation characteristics at 280° C. or higher is 50 or greater and the component ratio of the heavy fraction is 1 percent by volume or more and 60 percent by volume or less of the whole fraction volume of the composition. Further, the cetane number of the heavy fraction is preferably 52 or greater, more preferably 54 or greater. The component ratio of the fraction is preferably 5 percent by volume or more and 55 percent by volume or less, more preferably 10 percent by volume or more and 50 percent by volume or less, more preferably 15 percent by volume or more and 45 percent by volume or less of the whole fraction volume.

The gas oil composition (No. 3) of the present invention is assumed to be used during a winter season and would be lowered in caloric value and thus poor in fuel consumption if containing too much light fraction (fraction with distillation characteristics at lower than 200° C.). However, the composition would be poor in evaporation characteristics unless containing the light fraction in a certain amount. Further, if the light fraction which is likely to evaporate is too high in cetane number, the composition would cause unintentional self-ignition to start before being sufficiently mixed with air, resulting in a failure to achieve homogeneous charge compression ignition combustion. However, if the cetane number is too low, self-ignition is likely to delay extremely.

As the result of various studies in view of the foregoing tendency, it is necessary that the cetane number of the fraction with distillation characteristics at lower than 200° C. is 20 or greater and less than 40 and the component ratio of the fraction is 20 percent by volume or more and less than 40 percent by volume of the whole fraction volume of the composition. Further, the cetane number of the fraction is preferably 21 or greater and 39 or less, more preferably 22 or greater and 38 or less. The component ratio of the fraction is preferably 21 percent by volume or more and 39.5 percent by volume or less, more preferably 22 percent by volume or more and 39 percent by volume or less of the whole fraction volume.

The gas oil composition (No. 3) of the present invention is mainly composed of a middle fraction (fraction with distillation characteristics within the range of 200° C. or higher and lower than 280° C.). That is, it is necessary to restrict the amount of the light fraction to suppress deterioration of fuel consumption as described above and also to restrict the amount of the middle fraction so as to maintain the evaporation characteristics. It is preferable to set the cetane number of the middle fraction slightly higher to allow the composition to self-ignite positively since the middle fraction is mainly involved with ignition.

As the result of various studies in view of the foregoing tendency, it is necessary that the cetane number of the middle fraction with distillation characteristics within the range of 200° C. or higher and lower than 280° C. is 30 or greater and less than 60 and the component ratio of the middle fraction is 30 percent by volume or more and less than 78 percent by volume of the whole fraction volume of the composition. Further, the cetane number of the middle fraction is preferably 31 or greater and 59 or less, more preferably 32 or greater and 58 or less. The component ratio of the fraction is preferably 32 percent by volume or more and 75 percent by volume or less, more preferably 35 percent by volume or more and 70 percent by volume or less of the whole fraction volume.

The heavy fraction (fraction with distillation characteristics at 280° C. or higher) of the gas oil composition (No. 3) of the present invention is large in calorific value per volume and thus important for improving the output and fuel consumption. However, this fraction would possibly produce soot if the combustion surrounding conditions (temperature, pressure and ratio with air) are not suitable. Further, the gas oil composition (No. 3) of the present invention is assumed to be used during a winter season and would possibly be deteriorated in low-temperature flowability if containing too much heavy fraction. It is necessary to determine the blend ratio of the heavy fraction considering the balance with the above-described light and middle fractions. The heavy fraction requires to take sufficient time to be mixed with air because it is slow in evaporation speed and thus can not be blended in a large amount. Therefore, the heavy fraction needs to be excellent in self-ignition properties.

As the result of various studies in view of the foregoing tendency, it is necessary that the cetane number of the heavy fraction with distillation characteristics at 280° C. or higher is 50 or greater and the component ratio of the heavy fraction is 1 percent by volume or more and 50 percent by volume or less of the whole fraction volume of the composition. Further, the cetane number of the heavy fraction is preferably 52 or greater, more preferably 54 or greater. The component ratio of the fraction is preferably 2 percent by volume or more and 47 percent by volume or less, more preferably 3 percent by volume or more and 45 percent by volume or less, more preferably 5 percent by volume or more and 40 percent by volume or less of the whole fraction volume.

The gas oil composition (Special No. 3) of the present invention is assumed to be used during a winter season and would be lowered in caloric value and thus poor in fuel consumption if containing too much light fraction (fraction with distillation characteristics at lower than 200° C.). However, the composition would be poor in evaporation characteristics unless containing the light fraction in a certain amount. Further, if the light fraction which is likely to evaporate is too high in cetane number, the composition would cause unintentional self-ignition to start before being sufficiently mixed with air, resulting in a failure to achieve homogeneous charge compression ignition combustion. However, if the cetane number is too low, self-ignition is likely to delay extremely.

As the result of various studies in view of the foregoing tendency, it is necessary that the cetane number of the fraction with distillation characteristics at lower than 200° C. is 20 or greater and less than 40 and the component ratio of the fraction is 40 percent by volume or more and less than 70 percent by volume of the whole fraction volume of the composition. Further, the cetane number of the fraction is preferably 21 or greater and 39 or less, more preferably 22 or greater and 38 or less. The component ratio of the fraction is preferably 41 percent by volume or more and 69.5 percent by volume or less, more preferably 42 percent by volume or more and 69 percent by volume or less of the whole fraction volume.

The gas oil composition (Special No. 3) of the present invention is mainly composed of a middle fraction (fraction with distillation characteristics within the range of 200° C. or higher and lower than 280° C.). That is, it is necessary to restrict the amount of the light fraction to suppress the deterioration of fuel consumption as described above and also to restrict the amount of the middle fraction so as to maintain the evaporation characteristics. It is preferable to set the cetane number of the middle fraction slightly higher to allow the composition to self-ignite positively since the middle fraction is mainly involved with ignition.

As the result of various studies in view of the foregoing tendency, it is necessary that the cetane number of the middle fraction with distillation characteristics within the range of 200° C. or higher and lower than 280° C. is 30 or greater and less than 60 and the component ratio of the middle fraction is 20 percent by volume or more and 59 percent by volume or less of the whole fraction volume of the composition. Further, the cetane number of the middle fraction is preferably 31 or greater and 59 or less, more preferably 32 or greater and 58 or less. The component ratio of the fraction is preferably 22 percent by volume or more and 57 percent by volume or less, more preferably 25 percent by volume or more and 55 percent by volume or less of the whole fraction volume.

The heavy fraction (fraction with distillation characteristics at 280° C. or higher) of the gas oil composition (Special No. 3) of the present invention is large in calorific value per volume and thus important for improving the output and fuel consumption. However, this fraction would possibly produce soot if the combustion surrounding conditions (temperature, pressure and ratio with air) are not suitable. Further, the gas oil composition (Special No. 3) of the present invention is assumed to be used during a winter season and would possibly be deteriorated in low-temperature flowability if containing too much heavy fraction. It is necessary to determine the blend ratio of the heavy fraction considering the balance with the above-described light and middle fractions. The heavy fraction requires to take sufficient time to be mixed with air because it is slow in evaporation speed and thus can not be blended in a large amount. Therefore, the heavy fraction needs to be excellent in self-ignition properties.

As the result of various studies in view of the foregoing tendency, it is necessary that the cetane number of the heavy fraction with distillation characteristics at 280° C. or higher is 50 or greater and the component ratio of the heavy fraction is 1 percent by volume or more and 30 percent by volume or less of the whole fraction volume of the composition. Further, the cetane number of the heavy fraction is preferably 52 or greater, more preferably 54 or greater. The component ratio of the fraction is preferably 1.5 percent by volume or more and 28 percent by volume or less, more preferably 2 percent by volume or more and 26 percent by volume or less of the whole fraction volume.

The component ratio of each fraction and the cetane number thereof may be measured by the following two types of methods wherein:

(1) a gas oil composition is separated to fractions of initial boiling point to 200° C., 200° C. to 280° C. and 280° C. to end point, using a distillation unit with such a relatively high accuracy that the distillation accuracy is ±1° C. with respect to the intended temperature, and then the residual oil ratio is within 1 percent by volume, and the component ratio of each fraction and cetane number thereof are measured; and (2) base oils to be mixed are distilled to each fraction using the foregoing unit beforehand and the component ratio of each fraction and cetane number thereof are measured.

Distillation characteristics are measured in accordance with JIS K 2254 "Petroleum products-Determination of distillation characteristics" and cetane number is measured in accordance with "7. Cetane number test method" prescribed in JIS K 2280 "Petroleum products-Fuels-Determination of octane number, cetane number and calculation of cetane index".

With regard to distillation characteristics, the gas oil composition (No. 1) of the present invention has necessarily the above-described characteristics in each fraction, an initial boiling point of 140° C. or higher, an end point of 380° C. or lower, and a 90% distillation temperature of 360° C. or lower, that is one of the JIS No. 1 gas oil standards.

If the 90% distillation temperature is in excess of 360° C., emission of PM or fine particles would be likely increased. Therefore, the 90% distillation temperature is preferably 355° C. or lower, more preferably 350° C. or lower, more preferably 345° C. or lower. There is no particular restriction on the lower limit of the 90% distillation temperature. However, if the 90% distillation temperature is too low, it would induce deterioration of fuel consumption or reduction of engine output.

Therefore, the lower limit 90% distillation temperature is preferably 240° C. or higher, more preferably 250° C. or higher, more preferably 260° C. or higher, more preferably 270° C. or higher.

The initial boiling point is necessarily 140° C. or higher. If the initial boiling point is lower than 140° C., the engine output and high-temperature startability would tend to be extremely reduced and deteriorated. Therefore, the initial boiling point is preferably 145° C. or higher, more preferably 150° C. or higher. The end point is necessarily 380° C. or lower. If the end point is in excess of 380° C., emission of PM or fine particles would be likely increased. Therefore, the end point is preferably 375° C. or lower, more preferably 370° C. or lower.

There is no particular restriction on the 10% distillation temperature. However, the lower limit is preferably 160° C. or higher, more preferably 170° C. or higher, more preferably 180° C. or higher with the objective of suppressing reduction of engine output and deterioration of high-temperature startability. The upper limit is preferably 250° C. or lower, more preferably 245° C. or lower, more preferably 230° C. or lower with the objective of suppressing deterioration of exhaust gas properties.

With regard to distillation characteristics, the gas oil composition (No. 2) of the present invention has necessarily the above-described characteristics in each fraction, an initial boiling point of 140° C. or higher, an end point of 360° C. or lower, and a 90% distillation temperature of 350° C. or lower, that is one of the JIS No. 2 gas oil standards.

If the 90% distillation temperature is in excess of 350° C., emission of PM or fine particles would be likely increased. Therefore, the 90% distillation temperature is preferably 345° C. or lower, more preferably 340° C. or lower, more preferably 335° C. or lower. There is no particular restriction on the lower limit of the 90% distillation temperature. However, if the 90% distillation temperature is too low, it would induce deterioration of fuel consumption or reduction of engine output. Therefore, the lower limit 90% distillation temperature is preferably 240° C. or higher, more preferably 250° C. or higher, more preferably 260° C. or higher.

The initial boiling point is necessarily 140° C. or higher. If the initial boiling point is lower than 140° C., engine output and high-temperature startability would tend to be reduced and deteriorated. Therefore, the initial boiling point is preferably 145° C. or higher, more preferably 150° C. or higher. The end point is necessarily 360° C. or lower. If the end point is in excess of 360° C., emission of PM or fine particles would be likely increased. Therefore, the end point is preferably 368° C. or lower, more preferably 366° C. or lower.

There is no particular restriction on the 10% distillation temperature. However, the lower limit is preferably 160° C. or higher, more preferably 170° C. or higher, more preferably 180° C. or higher with the objective of suppressing reduction of engine output and deterioration of fuel consumption. The upper limit is preferably 250° C. or lower, more preferably 245° C. or lower, more preferably 230° C. or lower with the objective of suppressing deterioration of exhaust gas properties.

With regard to distillation characteristics, the gas oil composition (No. 3) of the present invention has necessarily the above-described characteristics in each fraction, an initial boiling point of 140° C. or higher, an end point of 360° C. or lower, and a 90% distillation temperature of 350° C. or lower, that is one of the JIS No. 3 gas oil standards.

If the 90% distillation temperature is in excess of 350° C., emission of PM or fine particles would be likely increased. Therefore, the 90% distillation temperature is preferably 345° C. or lower, more preferably 340° C. or lower, more preferably 335° C. or lower. There is no particular restriction on the lower limit of the 90% distillation temperature. However, if the 90% distillation temperature is too low, it would induce deterioration of fuel consumption or reduction of engine output. Therefore, the lower limit 90% distillation temperature is preferably 240° C. or higher, more preferably 250° C. or higher, more preferably 260° C. or higher.

The initial boiling point is necessarily 140° C. or higher. If the initial boiling point is lower than 140° C., the engine output and high-temperature startability would tend to be reduced and deteriorated. Therefore, the initial boiling point is preferably 145° C. or higher, more preferably 150° C. or higher. The end point is necessarily 360° C. or lower. If the end point is in excess of 360° C., emission of PM or fine particles would be likely increased. Therefore, the end point is preferably 358° C. or lower, more preferably 356° C. or lower.

There is no particular restriction on the 10% distillation temperature. However, the lower limit is preferably 160° C. or higher, more preferably 170° C. or higher, more preferably 180° C. or higher with the objective of suppressing reduction of engine output and deterioration of fuel consumption. The upper limit is preferably 250° C. or lower, more preferably 245° C. or lower, more preferably 230° C. or lower with the objective of suppressing deterioration of exhaust gas properties.

With regard to distillation characteristics, the gas oil composition (Special No. 3) of the present invention has necessarily the above-described characteristics in each fraction, an initial boiling point of 140° C. or higher, an end point of 350° C. or lower, and a 90% distillation temperature of 330° C. or lower, that is one of the JIS Special No. 3 gas oil standards.

If the 90% distillation temperature is in excess of 330° C., emission of PM or fine particles would be likely increased. Therefore, the 90% distillation temperature is preferably 325° C. or lower, more preferably 320° C. or lower, more preferably 315° C. or lower. There is no particular restriction on the lower limit of the 90% distillation temperature. However, if the 90% distillation temperature is too low, it would induce deterioration of fuel consumption or reduction of engine output. Therefore, the lower limit 90% distillation temperature is preferably 240° C. or higher, more preferably 250° C. or higher, more preferably 260° C. or higher.

The initial boiling point is necessarily 140° C. or higher. If the initial boiling point is lower than 140° C., the engine output and high-temperature startability would tend to be reduced and deteriorated. Therefore, the initial boiling point is preferably 145° C. or higher, more preferably 150° C. or higher. The end point is necessarily 350° C. or lower. If the end point is in excess of 350° C., emission of PM or fine particles would be likely increased. Therefore, the end point is preferably 348° C. or lower, more preferably 346° C. or lower.

There is no particular restriction on the 10% distillation temperature. However, the lower limit is preferably 160° C. or higher, more preferably 170° C. or higher, more preferably 180° C. or higher with the objective of suppressing reduction of engine output and deterioration of fuel consumption. The upper limit is preferably 250° C. or lower, more preferably 245° C. or lower, more preferably 230° C. or lower with the objective of suppressing deterioration of exhaust gas properties.

The initial boiling point, 10% distillation temperature, 90% distillation temperature and end point used herein denote the values measured in accordance with JIS K 2254 "Petroleum products-Determination of distillation characteristics".

The cetane index of the gas oil composition (No. 1) of the present invention necessarily fulfils the JIS No. 1 gas oil standard that is 50 or greater. If the cetane index is lower than 50, it is likely that the concentrations of PM, aldehydes, and NOx would be increased. For the same reasons, the cetane index is preferably 52 or greater, more preferably 55 or greater. There is no particular restriction on the upper limit of the cetane index. However, if the cetane index is greater than 75, discharge of soot would likely be increased during the acceleration of a vehicle. Therefore, the cetane index is preferably 75 or less, more preferably 74 or less, more preferably 73 or less.

The cetane indices of the gas oil compositions (No. 2), (No. 3) and (Special No. 3) of the present invention necessarily fulfils the JIS No. 2, No. 3 and Special No. 3 gas oil standards, respectively, each of which is 45 or greater. If the cetane index is lower than 45, it is likely that the concentrations of PM, aldehydes, and NOx would be increased. For the same reasons, the cetane index is preferably 47 or greater, more preferably 50 or greater. There is no particular restriction on the upper limit of the cetane index. However, if the cetane number is greater than 75, discharge of soot would likely be increased during the acceleration of a vehicle. Therefore, the cetane index is preferably 75 or less, more preferably 74 or less, more preferably 73 or less.

The cetane index used herein denotes the value calculated in accordance with "8.4 cetane index calculation method using variables equation" prescribed in JIS K 2280 "Petroleum products-Fuels-Determination of octane number, cetane number and calculation of cetane index". The cetane index defined by the JIS standards is generally applied to gas oil containing no cetane number improver. However, in the present invention, "8.4 cetane index calculation method using variables equation" is applied to a gas oil containing a cetane number improver, and the value obtained thereby is also defined as cetane index.

There is no particular restriction on the cetane number of the gas oil compositions of the present invention as long as the characteristics of each fraction described above are satisfied. However, the cetane number is preferably 30 or greater, more preferably 35 or greater, more preferably 40 or greater with the objective of inhibiting knocking during diesel combustion and reducing discharge of NOx, PM and aldehydes in the exhaust gas. With the objective of reducing black smoke in the exhaust gas, the cetane number is preferably 70 or lower, more preferably 68 or lower, more preferably 66 or lower. The cetane number used herein denotes the cetane number measured in accordance with "7. Cetane number test method" prescribed in JIS K 2280 "Petroleum products-Fuels-Determination of octane number, cetane number and calculation of cetane index".

The flash points of the gas oil compositions (No. 1) and (No. 2) of the present invention necessarily satisfy the JIS No. 1 and No. 2 gas oil standards, respectively both of which are 50° C. or higher. A flash point of lower than 50° C. is not preferable in view of safety. Therefore, the flash point is preferably 52° C. or higher, more preferably 54° C. or higher.

The flash points of the gas oil compositions (No. 3) and (Special No. 3) of the present invention necessarily satisfy the JIS No. 3 and Special No. 3 gas oil standards, respectively both of which are 45° C. or higher. A flash point of lower than 45° C. is not preferable in view of safety. Therefore, the flash point is preferably 47° C. or higher, more preferably 50° C. or higher.

The flash point used herein denotes the value measured in accordance with JIS K 2265 "Crude oil and petroleum products-Determination of flash point".

The plugging point of the gas oil composition (No. 1) of the present invention necessarily satisfies the JIS No. 1 gas oil standard, which is −1° C. or lower. The plugging point is preferably—3° C. or lower, more preferably −5° C. or lower with the objective of preventing plugging of the pre-filter of a diesel powered automobile and maintaining the injection performance of an electronically controlled fuel injection pump.

The plugging point of the gas oil composition (No. 2) of the present invention necessarily satisfies the JIS No. 2 gas oil standard, which is −5° C. or lower. The plugging point is preferably—7° C. or lower, more preferably −10° C. or lower with the objective of preventing plugging of the pre-filter of a diesel powered automobile and maintaining the injection performance of an electronically controlled fuel injection pump.

The plugging point of the gas oil composition (No. 3) of the present invention necessarily satisfies the JIS No. 3 gas oil standard, which is −12° C. or lower. The plugging point is preferably—13° C. or lower, more preferably −15° C. or lower with the objective of preventing plugging of the pre-filter of a diesel powered automobile and maintaining the injection performance of an electronically controlled fuel injection pump.

The plugging point of the gas oil composition (Special No. 3) of the present invention necessarily satisfies the JIS Special No. 3 gas oil standard, which is −19° C. or lower. The plugging point is preferably −22° C. or lower, more preferably −25° C. or lower with the objective of preventing plugging of the pre-filter of a diesel powered automobile and maintaining the injection performance of an electronically controlled fuel injection pump.

The plugging point used herein denotes the cold filter plugging point measured in accordance with JIS K 2288 "Gas oil-Determination of cold filter plugging point".

The pour point of the gas oil composition (No. 1) of the present invention necessarily satisfies the JIS No. 1 gas oil standard, which is −2.5° C. or lower. Further, with the objective of securing low-temperature startability or drivability and maintaining the injection performance of an electronically controlled fuel injection pump, the pour point is preferably −5° C. or lower, preferably—7.5° C. or lower.

The pour point of the gas oil composition (No. 2) of the present invention necessarily satisfies the JIS No. 2 gas oil standard, which is −7.5° C. or lower. Further, with the objective of securing low-temperature startability or drivability and maintaining the injection performance of an electronically controlled fuel injection pump, the pour point is preferably −10° C. or lower, preferably −12.5° C. or lower.

The pour point of the gas oil composition (No. 3) of the present invention necessarily satisfies the JIS No. 3 gas oil standard, which is −20° C. or lower. Further, with the objective of securing low-temperature startability or drivability and maintaining the injection performance of an electronically controlled fuel injection pump, the pour point is preferably −22.5° C. or lower, preferably −25° C. or lower.

The pour point of the gas oil composition (Special No. 3) of the present invention necessarily satisfies the JIS Special No. 3 gas oil standard, which is −30° C. or lower. Further, with the objective of securing low-temperature startability or drivability and maintaining the injection performance of an electronically controlled fuel injection pump, the pour point is preferably −32.5° C. or lower, preferably −35° C. or lower.

The pour point used herein denotes the pour point measured in accordance with JIS K 2269 "Testing Method for Pour Point and Cloud Point of Crude Oil and Petroleum Products".

The kinematic viscosity at 30° C. of the gas oil composition (No. 1) of the present invention necessarily satisfies the JIS No. 1 gas oil standard, which is 2.7 $mm^2/s$ or higher, preferably 2.75 $mm^2/s$ or higher, more preferably 2.8 $mm^2/s$ or higher. If the kinematic viscosity is lower than 2.7 $mm^2/s$, it would be difficult to control the fuel injection timing at the fuel injection pump side, and lubricity at each part of the fuel injection pump installed in an engine would be reduced. There is no particular restriction on the upper limit kinematic viscosity at 30° C. However, the kinematic viscosity is preferably 5 $mm^2/s$ or lower, more preferably 4.8 $mm^2/s$ or lower, more preferably 4.5 $mm^2/s$ or lower with the objective of suppressing increase of the NOx and PM concentrations in the exhaust gas, caused by destabilization of the fuel injection system due to an increase in resistance therein.

The kinematic viscosity at 30° C. of the gas oil composition (No. 2) of the present invention necessarily satisfies the JIS No. 2 gas oil standard, which is 2.5 $mm^2/s$ or higher, preferably 2.55 $mm^2/s$ or higher, more preferably 2.6 $mm^2/s$ or higher. If the kinematic viscosity is lower than 2.5 $mm^2/s$, it would be difficult to control the fuel injection timing at the fuel injection pump side, and lubricity at each part of the fuel injection pump installed in an engine would be reduced. There is no particular restriction on the upper limit kinematic viscosity at 30° C. However, the kinematic viscosity is preferably 5 $mm^2/s$ or lower, more preferably 4.8 $mm^2/s$ or lower, more preferably 4.5 $mm^2/s$ or lower with the objective of suppressing increase of the NOx and PM concentrations in the exhaust gas, caused by destabilization of the fuel injection system due to an increase in resistance therein.

The kinematic viscosity at 30° C. of the gas oil composition (No. 3) of the present invention necessarily satisfies the JIS No. 3 gas oil standard, which is 2.0 $mm^2/s$ or higher, preferably 2.05 $mm^2/s$ or higher, more preferably 2.1 $mm^2/s$ or higher. If the kinematic viscosity is lower than 2.0 $mm^2/s$, it would be difficult to control the fuel injection timing at the fuel injection pump side, and lubricity at each part of the fuel injection pump installed in an engine would be reduced. There is no particular restriction on the upper limit kinematic viscosity at 30° C. However, the kinematic viscosity is preferably 5 $mm^2/s$ or lower, more preferably 4.8 $mm^2/s$ or lower, more preferably 4.5 $mm^2/s$ or lower with the objective of suppressing increase of the NOx and PM concentrations in the exhaust gas, caused by destabilization of the fuel injection system due to an increase in resistance therein.

The kinematic viscosity at 30° C. of the gas oil composition (Special No. 3) of the present invention necessarily satisfies the JIS Special No. 3 gas oil standard, which is 1.7 $mm^2/s$ or higher, preferably 1.75 $mm^2/s$ or higher, more preferably 1.8 $mm^2/s$ or higher. If the kinematic viscosity is lower than 1.7 $mm^2/s$, it would be difficult to control the fuel injection timing at the fuel injection pump side, and lubricity at each part of the fuel injection pump installed in an engine would be reduced. There is no particular restriction on the upper limit kinematic viscosity at 30° C. However, the kinematic viscosity is preferably 5 $mm^2/s$ or lower, more preferably 4.8 $mm^2/s$ or lower, more preferably 4.5 $mm^2/s$ or lower with the objective of suppressing increase of the NOx and PM concentrations in the exhaust gas, caused by destabilization of the fuel injection system due to an increase in resistance therein.

The kinematic viscosity used herein denotes the value measured in accordance with JIS K 2283 "Crude petroleum and petroleum products-Determination of kinematic viscosity and calculation of viscosity index from kinematic viscosity".

The carbon residue of the 10% distillation residue of the gas oil compositions of the present invention is necessarily 0.1 percent by mass or less, which satisfies the JIS No. 1, No. 2, No. 3 and Special No. 3 gas oil standards. Further, the carbon residue is preferably 0.08 percent by mass or less, more preferably 0.05 percent by mass or less with the objective of reducing fine particles and PM, maintaining the performances of the exhaust-gas post-processing system installed in an engine and preventing sludge from plugging a filter.

The carbon residue of the 10% distillation residue used herein denotes that measured in accordance with JIS K 2270 "Crude petroleum and petroleum products-Determination of carbon residue".

The peroxide number of the gas oil compositions of the present invention after an accelerated oxidation test (oxidation stability test) is preferably 50 ppm by mass or less, more preferably 40 ppm by mass or less, 30 ppm by mass or less in view of storage stability and compatibility to parts. The peroxide number after an accelerated oxidation test used herein denotes the value measured in accordance with JPI-5S-46-96 prescribed in JPI Standard after an accelerated oxidation test is carried out at a temperature of 95° C. under oxygen bubbling for 16 hours in accordance with ASTM D2274-94. If necessary, the gas oil compositions of the present invention may be blended with additives such as anti-oxidants or metal deactivators in order to reduce the peroxide number.

The aromatic content of the gas oil compositions of the present invention is preferably 15 percent by volume or less, more preferably 14 percent by volume or less, more preferably 13 percent by volume or less, more preferably 12 percent by volume or less. When the compositions have an aromatic content of 15 percent by volume or less, they can suppress the formation of PM, exhibit environment friendly properties even during diesel combustion and homogeneous charge compression ignition combustion and achieve easily and certainly characteristics defined in the present invention. The aromatic content used herein denotes the volume percentage (volume %) of the aromatic component content measured in accordance with JPI-5S-49-97 "Petroleum Products-Determination of Hydrocarbon Types-High Performance Liquid Chromatography" prescribed in JPI Standard and Manuals Testing Method for Petroleum Products published by Japan Petroleum Inst.

There is no particular restriction on the naphthene content of the gas oil compositions of the present invention. However, the naphthene content is preferably 50 percent by mass or less, more preferably 45 percent by mass or less, more preferably 40 percent by mass or less. When the gas oil compositions have a naphthene content of 50 percent by mass or less, they can suppress the formation of PM, exhibit environment friendly properties even during diesel combustion and homogeneous charge compression ignition combustion and achieve easily and certainly characteristics defined in the present invention. The naphthene content used herein denotes the volume percentage (volume %) of the naphthene content measured in accordance with ASTM D2425 "Standard Test Method for Hydrocarbon Types in Middle Distillates by Mass Spectrometry".

There is no particular restriction on the normal paraffin content (normal paraffin components) of the gas oil compositions of the present invention. The normal paraffin content is preferably 5 percent by mass or more, more preferably 7 percent by mass or more, more preferably 10 percent by mass or more with the objective of rendering the ignition controllability of homogeneous charge compression ignition combustion easier. The normal paraffin content is the value measured using GC-FID wherein the column is a capillary column formed of methyl silicone (ULTRA ALLOY-1), the carrier gas is helium and the detector is a flame ionization detector (FID), under conditions wherein the column length is 30 m, the carrier gas flow rate is 1.0 mL/min, the ratio of division is 1:79, the sample injection temperature is 360° C., the column is heated up from 140° C. to 355° C. (8° C/min), and the detector temperature is 360° C.

There is no particular restriction on the density at 15° C. of the gas oil compositions of the present invention. The density at 15° C. is preferably 760 kg/m$^3$ or higher, more preferably 765 kg/cm$^3$ or higher, and more preferably 770 kg/cm$^3$ or higher with the objective of maintaining the calorific value. The density is preferably 840 kg/cm$^3$ or lower, more preferably 835 kg/cm$^3$ or lower, and more preferably 830 kg/cm$^3$ or lower with the objective of reducing NOx and PM emission. The density used herein denotes the density measured in accordance with JIS K 2249 "Crude petroleum and petroleum products-Determination of density and petroleum measurement tables based on a reference temperature (15° C.)".

There is no particular restriction on the cloud point of the gas oil composition (No. 1) of the present invention. However, the cloud point is preferably −1° C. or lower, more preferably −3° C. or lower, more preferably −5° C. or lower with the objective of securing low-temperature startability and drivability and with the objective of maintaining the injection performance of an electronically controlled fuel injection pump.

There is no particular restriction on the cloud point of the gas oil composition (No. 2) of the present invention. However, the cloud point is preferably −3° C. or lower, more preferably −4° C. or lower, more preferably −5° C. or lower with the objective of securing low-temperature startability and drivability and with the objective of maintaining the injection performance of an electronically controlled fuel injection pump.

There is no particular restriction on the cloud point of the gas oil composition (No. 3) of the present invention. However, the cloud point is preferably −10° C. or lower, more preferably −11° C. or lower, more preferably −12° C. or lower with the objective of securing low-temperature startability and drivability and with the objective of maintaining the injection performance of an electronically controlled fuel injection pump.

There is no particular restriction on the cloud point of the gas oil composition (Special No. 3) of the present invention. However, the cloud point is preferably −15° C. or lower, more preferably −16° C. or lower, more preferably −17° C. or lower with the objective of securing low-temperature startability and drivability and with the objective of maintaining the injection performance of an electronically controlled fuel injection pump.

The cloud point used herein denotes the pour point measured in accordance with JIS K 2269 "Testing Method for Pour Point and Cloud Point of Crude Oil and Petroleum Products".

There is no particular restriction on the water content of the gas oil compositions of the present invention. However, the water content is preferably 100 ppm by volume, more preferably 50 ppm by volume, more preferably 20 ppm by volume with the objective of preventing the compositions from freezing and the engine interior from corroding. The water content used herein denotes the value measured in accordance with JIS K 2275 "Crude oil and petroleum products—Determination of water content—Potentiometric Karl Fischer titration method".

The total insoluble content of the gas oil compositions of the present invention after an oxidation stability test is preferably 2.0 mg/100 mL or less, more preferably 1.5 mg/100 mL or less, more preferably 1.0 mg/100 mL or less, and more preferably 0.5 mg/100 mL or less in view or storage stability. The oxidation stability test used herein is carried out at a temperature of 95° C. under oxygen bubbling for 16 hours in accordance with ASTM D2274-94. The total insoluble content after an oxidation stability test referred herein denotes the value measured in accordance with the foregoing oxidation stability test.

If necessary, the gas oil compositions of the present invention may be blended with additives such as cold flow improvers, lubricity improvers, cetane number improvers, and detergents in suitable amounts.

The gas oil compositions of the present invention may be blended with a cold flow improver with the objective of preventing the filter of a diesel powered automobile from plugging. The amount of the cold flow improver is 200 mg/L or more and 1000 mg/L or less, more preferably 300 mg/L or more and 800 mg/L or less in terms of the active component concentration.

There is no particular restriction on the cold flow improver which, therefore, may be one or more types of cold flow improvers, including ethylene-unsaturated ester copolymers such as ethylene-vinyl acetate copolymers; alkenyl succiniamides; linear compounds such as dibehenic acid esters of polyethylene glycols; polar nitrogen compounds composed of reaction products of acids such as phthalic acid, ethylenediaminetetraacetic acid and nitriloacetic acid or acid anhydride thereof and hydrocarbyl-substituted amines; and comb polymers composed of alkyl fumarates- or alkyl itaconatesunsaturated ester copolymers. Alternatively, the cold flow improver may be any one or two types selected from copolymers of ethylene and methyl methacrylate, copolymers of ethylene and α-olefin, chlorinated methylene-vinyl acetate copolymers, alkyl ester copolymers of unsaturated carboxylic acids, eaters synthesized from nitrogen-containing compounds having a hydroxyl group and saturated fatty acids and salts of the esters, esters and amide derivatives synthesized from polyhydric alcohols and saturated fatty acids, esters synthesized from polyoxyalkylene glycol and saturated fatty acid, esters synthesized from alkyleneoxide adducts of polyhydric alcohols or partial esters thereof and saturated fatty acids, chlorinated paraffin/naphthalene condensates, alkenyl succinamides, and amine salts of sulfobenzoic acids. Among these cold flow improvers, preferred are ethylene-vinyl acetate copolymer additives because they can be used for multi-purposes. Since commercially available products referred to as cold flow improvers are often in the form in which the active components contributing to the low-temperature fluidity (active components) are diluted with a suitable solvent. Therefore, the above amount of the cold flow improvers denotes the amount of the active components (active component concentration) when such commercially available products are added to the gas oil compositions of the present invention.

There is no particular restriction on addition of the lubricity improver in the gas oil compositions of the present invention as long as the lubricity of the resulting composition falls within the above-described preferable range. However, the lubricity improver is preferably added with the objective of preventing a fuel injection pump from wearing. The amount of the lubricity improver is preferably 20 mg/L or more and 200 mg/L or less, more preferably 50 mg/L or more and 180 mg/L or less, in terms of the concentration of the active component. When the lubricity improver is blended in an amount within these ranges, the lubricity improver can effectively exhibit its efficacy thereof. For example, in a diesel engine equipped with a distribution type injection pump, the lubricity improver can suppress the driving torque from increasing and can reduce wear on each part of the pump while the engine is driven.

There is no particular restriction on the type of the lubricity improver, which may, therefore, be any one or more type selected from carboxylic acid-, ester-, alcohol- and phenol-based lubricity improvers. Among these lubricity improvers, preferred are carboxylic acid- and ester-based lubricity improvers. The carboxylic acid-based lubricity improver may be linoleic acid, oleic acid, salicylic acid, palmitic acid, myristic acid or hexadecenoic acid or a mixture of two or more of these carboxylic acids. Examples of the ester-based lubricity improver include carboxylic acid esters of glycerin. The carboxylic acid forming the carboxylic acid ester may be of one or more types. Specific examples of the carboxylic acid include linoleic acid, oleic acid, salicylic acid, palmitic acid, myristic acid or hexadecenoic acid.

If necessary, the gas oil compositions of the present invention may be blended with a cetane number improver in a suitable amount to enhance the cetane number of the compositions.

The cetane number improver may be any of various compounds known as a cetane number improver for gas oil. Examples of such a cetane number improver include nitrate esters and organic peroxides. These cetane number improvers may be used alone or in combination. Preferred for use in the present invention are nitrate esters. Examples of the nitrate esters include various nitrates such as 2-chloroethyl nitrate, 2-ethoxyethyl nitrate, isopropyl nitrate, butyl nitrate, primary amyl nitrate, secondary amyl nitrate, isoamyl nitrate, primary hexyl nitrate, secondary hexyl nitrate, n-heptyl nitrate, n-octyl nitrate, 2-ethylhexyl nitrate, cyclohexyl nitrate, and ethylene glycol dinitrate. Particularly preferred are alkyl nitrates having 6 to 8 carbon atoms.

The content of the cetane number improver is preferably 500 mg/L or more, more preferably 600 mg/L or more, more preferably 700 mg/L or more, more preferably 800 mg/L or more, most preferably 900 mg/L or more. If the content of the cetane number improver is less than 500 mg/L, the cetane number improving effect may not be attained sufficiently, leading to a tendency that PM, aldehydes, and NOx in the exhaust gas from a diesel engine are not reduced sufficiently. There is no particular restriction on the upper limit content of the cetane number improver. However, the upper limit is preferably 1400 mg/L or less, more preferably 1250 mg/L or less, more preferably 1100 mg/L or less, and most preferably 1000 mg/L or less, on the basis of the total mass of the gas oil composition.

The cetane number improver may be any of those synthesized in accordance with conventional methods or commercially available products. Such products in the name of cetane number improver are available in a state wherein the effective component contributing to an improvement in cetane number (i.e., cetane number improver itself) is diluted with a suitable solvent. In the case where the gas oil composition of the present invention is prepared using any of such commercially available products, the content of the effective component is preferably within the above-described range.

If necessary, detergents may be added to the gas oil compositions of the present invention. There is no particular restriction on the detergents. Examples of the detergents include ashless dispersants, for example, imide compounds; alkenyl succinimides such as polybutenyl succinimide synthesized from polybutenyl succinic anhydrate and ethylene polyamines; succinic acid esters such as polybutenyl succinic acid ester synthesized from polyhydric alcohols such as pentaerythritol and polybutenyl succinic anhydrate; copolymerized polymers such as copolymers of dialkylaminoethyl methacrylates, polyethylene glycol methacrylates, or vinylpyrrolidon and alkylmethacrylates; and reaction products of carboxylic acids and amines. Among these, preferred are alkenyl succinimides and reaction products of carboxylic acids and amines. These detergents may be used alone or in combination. When an alkenyl succinimide is used, an alkenyl succinimide having a molecular weight of 1000 to 3000 may be used alone, or an alkenyl succinimide having a molecular weight of 700 to 2000 and an alkenyl succinimide having a molecular weight of 10000 to 20000 may be used in combination. Carboxylic acids constituting reaction products of carboxylic acids and amines may be of one or more types. Specific examples of the carboxylic acids include fatty acids having 12 to 24 carbon atoms and aromatic carboxylic acids having 7 to 24 carbon atoms. Examples of fatty acids having 12 to 24 carbon atoms include, but not limited thereto, linoleic acid, oleic acid, palmitic acid, and myristic acid. Examples of aromatic carboxylic acids having 7 to 24 carbon atoms include, but not limited thereto, benzoic acid and salicylic acid. Amines constituting reaction products of carboxylic acids and amines may be of one or more types. Typical examples of amines used herein include, but not limited thereto, oleic amines. Various amines may also be used.

There is no particular restriction on the amount of the detergent to be blended. However, the amount is preferably 30 mg/L or more, more preferably 60 mg/L or more, and more preferably 80 mg/L or more, on the basis of the total mass of the composition, because the detergent can perform its effect to suppress a fuel injection nozzle from plugging. The effect may not be obtained if the amount is less than 30 mg/L. On the other hand, if the detergent is blended in a too much amount, its effect as balanced with the amount is not obtained. Therefore, the amount of the detergent is preferably 300 mg/L or less and more preferably 180 mg/L or less because the detergent may increase the amounts of NOx, PM and aldehydes in the exhaust gas from a diesel engine. Conventional products in the name of detergent are available in a state wherein the effective component contributing to detergency is diluted with a suitable solvent. In the case where such products are blended with the gas oil compositions of the present invention, the content of the effective component is preferably within the above-described range.

In order to further enhance the properties of the gas oil compositions of the present invention, other known fuel oil additives (hereinafter referred to as "other additives" for convenience) may be used alone or in combination. Examples of the other additives include phenol- and amine-based antioxidants; metal deactivators such as salicyliden derivatives; anti-corrosion agents such as aliphatic amines and alkenyl succinic acid esters; anti-static additives such as anionic, cationic, and amphoteric surface active agents; coloring agents such as azo dye; silicone-based defoaming agents and anti-icing agents such as 2-methoxyethanol, isopropyl alcohol and polyglycol ethers.

The amounts of the other additives may be arbitrarily selected. However, the amount of each of the other additives is preferably 0.5 percent by mass or less, more preferably 0.2 percent by mass or less, on the basis of the total mass of the composition.

As described above, according to the present invention, the use of gas oil composition produced by the above-described process to satisfy the requirements for fractions can provide high quality gas oils that can achieve at a high level both an excellent practical performance under conditions in a summer or winter season and environment friendly properties that can be applied to homogenous charge compression ignition combustion, which performance and properties were difficult to accomplish with the conventional gas oil compositions.

Applicability in the Industry

The gas oil compositions of the present invention can be suitably used as those for a summer or winter season suitable for diesel combustion and homogeneous charge compression ignition combustion.

EXAMPLES

Hereinafter, the present invention will be described in more detail by way of the following examples and comparative examples, which should not be construed as limiting the scope of the invention.

The characteristics of gas oil compositions were measured by the following methods. The component ratio of each fraction and cetane number thereof were measured after base oils were blended and distilled.

The density referred herein denotes the density measured in accordance with JIS K 2249 "Crude petroleum and petroleum products-Determination of density and petroleum measurement tables based on a reference temperature (15° C.)".

The kinematic viscosity referred herein denotes the viscosity measured in accordance with JIS K 2283 "Crude petroleum and petroleum products-Determination of kinematic viscosity and calculation of viscosity index from kinematic viscosity".

The flash point referred herein denotes the value measured in accordance with JIS K 2265 "Crude oil and petroleum products-Determination of flash point".

The sulfur content (sulfur components) referred herein denotes the mass content of the sulfur components on the basis of the total mass of the composition, measured in accordance with JIS K 2541 "Crude oil and petroleum products-Determination of sulfur content".

The oxygen content (oxygen components) referred herein denotes the value measured with a thermal conductivity detector after the samples were converted to CO or alternatively further to CO2, on platinum carbon.

All of the distillation characteristics referred herein denotes the values measured in accordance with JIS K 2254 "Petroleum products-Determination of distillation characteristics". E200-Eibp, E280-E200, and Eep-E280 denote the amount (volume %) of the fraction distilled between the initial boiling point and 200° C., the amount (volume %) of the fraction distilled between 200° C. and 280° C., and the amount (volume %) of the fraction distilled between 280° C. and end point.

The normal paraffin components referred herein denote the value (mass %) measured using the above-described GC-FID.

The aromatic content referred herein denotes the volume percentage (volume %) of the aromatic component content measured in accordance with JPI-5S-49-97 "Petroleum Products-Determination of Hydrocarbon Types-High Performance Liquid Chromatography" prescribed in JPI Standard and Manuals Testing Method for Petroleum Products published by Japan Petroleum Inst.

The naphthene compound content referred herein denotes the volume percentage (volume %) of the naphthene content measured in accordance with ASTM D2524 "Standard Test Method for Hydrocarbon Types in Middle Distillates by Mass Spectrometry".

The bulk modulus referred herein was calculated on the basis of the change in pressure in a fixed-volume container when fuel to be measured is filled thereinto and a fixed-volume piston is inserted into the container, as described above.

The cloud point referred herein denotes that measured in accordance with JIS K 2269 "Testing Method for Pour Point and Cloud Point of Crude Oil and Petroleum Products".

The plugging point referred herein denotes that measured in accordance with JIS K 2288 "Gas oil-Determination of cold filter plugging point".

The pour point referred herein denotes that measured in accordance with JIS K 2269 "Testing Method for Pour Point and Cloud Point of Crude Oil and Petroleum Products".

The cetane index referred herein denotes the value calculated in accordance with "8.4 cetane number calculation method using variables equation" prescribed in JIS K 2280 "Petroleum products-Fuels-Determination of octane number, cetane number and calculation of cetane number". The cetane index defined by the JIS standards is not generally applied to gas oil containing a cetane number improver. However, in the present invention, "8.4 cetane number calculation method using variables equation" is applied to a gas oil containing a cetane number improver, and the value obtained thereby is also defined as cetane index.

The cetane number referred herein denotes that measured in accordance with "7. Cetane number test method" prescribed in JIS K 2280 "Petroleum products-Fuels-Determination of octane number, cetane number and calculation of cetane index".

The hue (saybolt) referred herein denotes a saybolt color measured in accordance with JIS K 2580 "Petroleum product-color test method-saybolt color test method".

The carbon residue content of the 10% distillation residue referred herein denotes that measured in accordance with JIS K 2270 "Crude petroleum and petroleum products-Determination of carbon residue".

The peroxide number after an oxidation stability test referred herein denotes the value measured in accordance with JPI-5S-46-96 prescribed in JPI Standard and Manuals Testing Method for Petroleum Products published by Japan Petroleum Inst after the compositions are subjected to an accelerated oxidation at a temperature of 95° C. under oxygen bubbling for 16 hours in accordance with ASTM D2274-94.

The insoluble content after an oxidation stability test referred herein denotes the value measured after the compositions are subjected to an accelerated oxidation at a temperature of 95° C. under oxygen bubbling for 16 hours in accordance with ASTM D2274-94.

The lubricity, i.e., HFRR wear scar diameter (WS 1.4) referred herein denotes lubricity measured in accordance with JPI-5S-50-98 "Gas oil-Testing Method for Lubricity" prescribed in JPI Standard and Manuals Testing Method for Petroleum Products published by Japan Petroleum Inst.

The water content referred herein denotes that measured in accordance with JIS K 2275 "Crude oil and petroleum products—Determination of water content—Potentiometric Karl Fischer titration method".

Examples 1 to 3 and Comparative Examples 1 to 3

Base oils with characteristics set forth in Table 1 were blended to produce gas oil compositions set forth in Table 2 (Examples 1 to 3 and Comparative Examples 1 to 3). FT synthetic base oils 1 to 3 are hydrocarbon mixtures produced by converting natural gas to wax or a middle fraction through FT reaction, followed by hydrotreating. Since the reaction conditions (isomerization degree) vary, the resulting base oils vary in the ratio of the saturated hydrocarbon content. The highly hydrotreated base oil is a hydrocarbon base oil produced by further hydrotreating a gas oil base oil to further reduce the sulfur and aromatic contents. The processed oil derived from an animal or vegetable oil is an oil produced by hydrotreating palm oil (whole component) used as the raw material to remove the foreign substance. The hydrorefined gas oil corresponds to a commercially available gas oil which is used in a summer season. The fuel for low compression ratio is a fuel produced by blending the FT synthetic oils, hydrorefined base oil and highly hydrotreated base oil in suitable amounts, for a low pressure ratio diesel engine. Therefore, this fuel satisfies the requirements for the gas oil compositions of the present invention, other than the mixed ratio of each fraction and cetane number thereof. The compositions of Examples 1 to 3 and Comparative Examples 1 to 3 were produced by blending these base oils in suitable amounts or using any of the base oils as the whole.

The additives used in these examples are as follows:

Lubricity improver: carboxylic acid mixture mainly containing linoleic acid; and Detergent: alkenyl succinimide mixture.

Table 2 sets forth the blend ratio of the gas oil compositions thus prepared and the 15° C. density, 30° C. kinematic viscosity, flash point, sulfur content, oxygen content, distillation characteristics, cetane index, cetane number, aromatic content, naphthene compound content, bulk modulus, cloud point, plugging point, pour point, hue, carbon residue content of the 10% distillation residue, insoluble content and peroxide number after an oxidation stability test, wear scar diameter and water content of each composition.

The gas oil compositions used in Examples 1 to 3 were produced by blending 20 percent by mass or more of the FT synthetic base oils as set forth in Table 2. Further, as apparent from Table 2, gas oil compositions satisfying the characteristics as defined herein were easily produced without fail, in Examples 1 to 3 wherein the FT synthetic base oils were blended within the range defined herein. On the other hand, as apparent from Comparative Examples 1 to 3, where the compositions were prepared not using the foregoing specific base oils and the composition was prepared using the specific base oils which, however, the component ratio of each fraction or the like does not satisfy the definition of the present invention, the gas oil compositions as intended by the present invention were not necessarily produced.

Next, the following various tests were carried out using the gas oil compositions of Examples 1 to 3 and Comparative Examples 1 to 3. All results are set forth in Table 3. As apparent from Table 3, the gas oil compositions of Examples 1 to 3 exhibited excellent results regarding NOx, smoke, fuel consumption and effective ignition delay period during homogeneous charge compression ignition combustion and NOx, smoke, fuel consumption and high-temperature startability during normal combustion, compared with the gas oil compositions of Comparative Examples 1 to 3. Therefore, the gas oil compositions of Examples 1 to 3 are apparently high-quality gas oils that can achieve at a high level both an excellent practical performance under conditions in a summer season and environment friendly properties that can be applied to homogenous charge compression ignition combustion, which performance and properties were difficult to accomplish with the conventional gas oil compositions.

(Homogeneous Charge Compression Ignition Combustion Test)

The test was carried out using an engine for experiment wherein on the basis of a commercially available engine 1 described below, the shape of the pistons of all the cylinders were changed to alter the compression ratio to 16 and the controlling part of the electronic controlled common rail type fuel injection pump are partly altered to make it possible to control the injection timing. The test was carried out under steady conditions (1200 rpm, 25% load equivalent conditions (input calorie between fuels was constant), fuel injection timing: 30° CA before top dead center, intake conditions: constant at normal temperature) to measure NOx, smoke and fuel consumption as well as effective ignition delay period. The effective ignition delay period is the value obtained by deducting the time required till ignition starts from the time required till fuel injection is completed. If the value is positive, it means that almost of all the injected fuel had enough time to be mixed with air, and thus homogeneous charge compression ignition combustion proceeds more effectively. Whereas, if the value is negative, it means that combustion starts before the fuel injection is completed, resulting in combustion which does not undergo sufficient premixing, accompanying extreme smoke generation. The fuel consumption was indicated by the relative value of the result of each composition against Comparative Example 1 which was set to 100 (lower value indicates better result).

The test concerning engine test was carried out in accordance with Exhibit 29 "Technical Standard for 13-Mode Exhaust Emission Test Procedure for Diesel Powered Motor Vehicles" supervised by former Ministry of Transport Japan.

(Engine specification): Commercially available engine 1

Engine type: in-line 6 cylinder supercharged engine with EGR

Displacement: 1.4 L

Internal diameter×stroke: 73 mm×81.4 mm

Compression ratio: 18.5 (altered so that the compression ratio would be 16.0 when the ignition-combustion test was carried out)

Maximum output: 72 kW/4000 rpm

Adopted regulation: 2002 Exhaust Gas Emission Regulation

Exhaust-gas post processing device: not used (Diesel Combustion Test)

The commercially available engine 1 with no alternation in compression ratio or injection system was used and operated at 3200 rpm-80% load equivalent conditions (input calorie between fuels was constant) to measure NOx, smoke and fuel consumption. The results of the fuel of Comparative Example 1 were defined as 100, and the results of the other fuels were relatively evaluated by comparison with the results of Comparative Example 1 (smaller values indicate better results).

(High-temperature Startability)

After the foregoing diesel combustion test was carried out, the temperature of the experiment room was kept at around 35° C. After completion of the diesel combustion test, the engines was idled for about 1 minute. Thereafter, the engine was stopped and left for 5 minutes and then restarted. Thereupon, if the fuel enabled the engine to start normally, it is evaluated as "Passed". If the engine did not start, took 10 seconds or longer to start, or had defects (hunting, stumble, vehicle speed reduction or engine stop), the fuel is evaluated as "Not Passed".

TABLE 1

| | | FT synthetic base oil 1 | FT synthetic base oil 2 | FT synthetic base oil 3 | Highly hydrogenated processed oil | Processed oil derived from animal or vegetable oil | Hydrorefined gas oil | Gas oil composition for low compression ratio |
|---|---|---|---|---|---|---|---|---|
| Density | (15° C.) kg/m$^3$ | 798 | 783 | 768 | 812 | 764 | 831 | 788 |
| Kinematic viscosity | (30° C.) mm$^2$/s | 4.7 | 3.9 | 2.3 | 3.5 | 2.2 | 4.4 | 3.5 |
| Distillation characteristics ° C. | 10% distillation temperature | 224.0 | 224.0 | 183.0 | 218.0 | 215.0 | 230.5 | 224.5 |
| | 50% distillation temperature | 249.0 | 289.0 | 249.0 | 271.0 | 249.0 | 292.0 | 255.0 |
| | 90% distillation temperature | 304.5 | 337.0 | 314.0 | 323.0 | 269.0 | 345.5 | 322.0 |
| Normal paraffin | mass % | 3.7 | 27.4 | 38.4 | 25.4 | 92.0 | 26.1 | 36.2 |
| Sulfur content | mass % | <1 | <1 | <1 | <1 | <1 | 7 | <1 |

TABLE 2

| | | Example 1 | Example 2 | Example 3 | Comparative Example 1 | Comparative Example 2 | Comparative Example 3 |
|---|---|---|---|---|---|---|---|
| FT synthetic base oil 1 | | 60 | 60 | 50 | | | |
| FT synthetic base oil 2 | | 20 | | 10 | | | |
| FT synthetic base oil 3 | | | | | 100 | | |
| Highly hydrogenated processed oil | | | 40 | | | | |
| Processed oil derived from animal or vegetable oil | | 20 | | | | | |
| Hydrorefined gas oil | | | | 40 | | 100 | |
| Gas oil composition for low compression ratio | | | | | | | 100 |
| Density | (15° C.) kg/m$^3$ | 788 | 804 | 810 | 768 | 831 | 788 |
| Kinematic viscosity | (30° C.) mm$^2$/s | 3.8 | 4.1 | 4.5 | 2.3 | 4.4 | 3.5 |
| Flash point | ° C. | 65 | 65 | 58 | 71 | 58 | 65 |
| Sulfur content | mass ppm | <1 | <1 | 3 | <1 | 7 | <1 |
| Oxygen content | mass ppm | <10 | <10 | 45 | 120 | 110 | <10 |
| Distillation characteristics ° C. | Initial boiling point | 174.0 | 184.0 | 173.0 | 159.0 | 178.0 | 175.5 |
| | 10% distillation temperature | 224.5 | 222.0 | 224.0 | 183.0 | 230.5 | 224.5 |
| | 50% distillation temperature | 251.0 | 253.0 | 257.0 | 249.0 | 292.0 | 255.0 |
| | 90% distillation temperature | 313.5 | 315.0 | 326.0 | 314.0 | 345.5 | 322.0 |
| | End point | 359.5 | 364.0 | 372.0 | 334.0 | 368.5 | 359.0 |
| E200-Eibp | Component ratio vol. % | 8.2 | 9.0 | 9.0 | 44.0 | 10.2 | 8.1 |
| | Cetane number | 26.5 | 28.8 | 30.2 | 62.0 | 38.0 | 50.3 |
| E280-E200 | Component ratio vol. % | 60.8 | 58.0 | 51.3 | 36.0 | 38.7 | 51.3 |
| | Cetane number | 41.8 | 46.3 | 46.9 | 81.0 | 58.0 | 67.5 |
| Eep-E280 | Component ratio vol. % | 31.0 | 33.0 | 39.7 | 30.0 | 51.1 | 40.6 |
| | Cetane number | 54.3 | 54.8 | 54.3 | 82.0 | 49.5 | 56.8 |
| Normal paraffin | mass % | 24.9 | 12.4 | 14.8 | 37.6 | 25.6 | 36.2 |
| Cetane index | | 72.2 | 64.2 | 62.6 | 80.0 | 60.7 | 72.9 |
| Cetane number | | 44.8 | 48.1 | 48.1 | 81.7 | 55.7 | 62.1 |
| Aromatic content | vol. % | <1 | <1 | 7.3 | <1 | 17.8 | <1 |
| Naphthene content | mass % | <1 | 24.0 | 11.2 | <1 | 40.3 | 12.0 |
| Bulk modulus | MPa | 1320 | 1370 | 1400 | 1190 | 1460 | 1380 |
| Cloud point | ° C. | −15.0 | −7.0 | −7.0 | −10.0 | −2.0 | −8.0 |
| Plugging point | ° C. | −15.0 | −11.0 | −8.0 | −12.0 | −5.0 | −9.0 |
| Pour point | ° C. | −25.0 | −12.5 | −10.0 | −15.0 | −7.5 | −10.0 |
| Hue (Saybolt) | | >+30 | >+30 | 28 | >+30 | +21 | >+30 |
| Carbon residue content of 10% distillation residue | mass % | 0.00 | 0.01 | 0.01 | 0.00 | 0.01 | 0.00 |
| Peroxide number | mass ppm | 1 | 0 | 9 | 1 | 54 | 2 |

TABLE 2-continued

| | | Example 1 | Example 2 | Example 3 | Comparative Example 1 | Comparative Example 2 | Comparative Example 3 |
|---|---|---|---|---|---|---|---|
| Wear scar diameter | (WS 1.4) μm | 360 | 360 | 360 | 420 | 450 | 360 |
| Insoluble content | mg/100 mL | 0.1 | 0.1 | 0.1 | 0.2 | 0.6 | 0.1 |
| Water content | vol. ppm | 15 | 18 | 8 | 47 | 44 | 9 |
| Lubricity improver | mg/L | 150 | 150 | 150 | 150 | 70 | 150 |
| Cold flow improver | mg/L | — | — | — | — | — | — |
| Detergent | mg/L | — | — | 100 | — | — | — |
| Cetane number improver | mg/L | — | — | — | — | — | — |

TABLE 3

| | | Example 1 | Example 2 | Example 3 | Comparative Example 1 | Comparative Example 2 | Comparative Example 3 |
|---|---|---|---|---|---|---|---|
| Homogeneous charge compression ignition combustion test | NOx ppm | 2 | 1 | 3 | 46 | 126 | 104 |
| | Smoke BSU | 0 | 0 | 0 | 1.0 | 2.6 | 2.2 |
| | Fuel consumption | 94 | 90 | 88 | 100 | 92 | 96 |
| | Effective ignition delay period ° CA | 3.0 | 2.7 | 2.3 | −4.5 | −2.8 | −3.1 |
| Diesel combustion test | NOx | 91 | 95 | 93 | 100 | 107 | 102 |
| | Smoke | 98 | 93 | 98 | 100 | 132 | 105 |
| | Fuel consumption | 96 | 91 | 92 | 100 | 91 | 98 |
| High-temperature startability test | 35° C. | Passed | Passed | Passed | Not Passed | Passed | Passed |

Examples 4 to 6 and Comparative Examples 4 to 6

Base oils with characteristics set forth in Table 4 were blended to produce gas oil compositions set forth in Table 5 (Examples 4 to 6 and Comparative Examples 4 to 6). FT synthetic base oils 4 to 6 are hydrocarbon mixtures produced by converting natural gas to wax or a middle fraction through FT reaction, followed by hydrotreating. Since the reaction conditions (isomerization degree) vary, the resulting base oils vary in the ratio of the saturated hydrocarbon content. The highly hydrotreated base oil is a hydrocarbon base oil produced by further hydrotreating a gas oil base oil to further reduce the sulfur and aromatic contents. The processed oil derived from an animal or vegetable oil is an oil produced by hydrotreating palm oil (whole component) used as the raw material to remove the foreign substance. The hydrorefined gas oil corresponds to a commercially available gas oil which is used in a winter season. The fuel for low compression ratio is a fuel produced by blending the FT synthetic oils, hydrorefined base oil and highly hydrotreated base oil in suitable amounts, for a low pressure ratio diesel engine. Therefore, this fuel satisfies the requirements for the gas oil compositions of the present invention, other than the mixed ratio of each fraction and cetane number thereof. The compositions of Examples 4 to 6 and Comparative Examples 4 to 6 were produced by blending these base oils in suitable amounts or using any of the base oils as the whole.

The additives used in these examples are as follows:

Lubricity improver: carboxylic acid mixture mainly containing linoleic acid;

Detergent: alkenyl succinimide mixture

Cold flow improver: ethylene-vinyl acetate copolymer mixture

Table 5 sets forth the blend ratio of the gas oil compositions thus prepared and the 15° C. density, 30° C. kinematic viscosity, flash point, sulfur content, oxygen content, distillation characteristics, cetane index, cetane number, aromatic content, naphthene compound content, bulk modulus, cloud point, plugging point, pour point, hue, carbon residue content of the 10% distillation residue, insoluble content and peroxide number after an oxidation stability test, wear scar diameter and water content of each composition.

The gas oil compositions used in Examples 4 to 6 were produced by blending 20 percent by mass or more of the FT synthetic base oils as set forth in Table 5. Further, as apparent from Table 5, gas oil compositions satisfying the characteristics as defined herein were easily produced without fail, in Examples 4 to 6 wherein the FT synthetic base oils were blended within the range defined herein. On the other hand, as apparent from Comparative Examples 4 to 6, where the compositions were prepared not using the foregoing specific base oils and the composition was prepared using the specific base oils which, however, the component ratio of each fraction or the like does not satisfy the definition of the present invention, the gas oil compositions as intended by the present invention were not necessarily produced.

Next, the following various tests were carried out using the gas oil compositions of Examples 4 to 6 and Comparative Examples 4 to 6. All results are set forth in Table 6. As apparent from Table 6, the gas oil compositions of Examples 4 to 6 exhibited excellent results regarding NOx, smoke, fuel consumption and effective ignition delay period during homogeneous charge compression ignition combustion, and NOx, smoke, fuel consumption and low-temperature startability during normal combustion, compared with the gas oil compositions of Comparative Examples 4 to 6. Therefore, the gas oil compositions of Examples 4 to 6 are apparently high-quality gas oils that can achieve at a high level both an excellent practical performance under conditions in a winter season and environment friendly properties that can be applied to homogenous charge compression ignition combustion, which performance and properties were difficult to accomplish with the conventional gas oil compositions.

(Homogeneous Charge Compression Ignition Combustion Test)

The test was carried out using an engine for experiment wherein on the basis of the above-mentioned commercially available engine 1 described below, the shape of the pistons of all the cylinders were changed to alter the compression ratio to 16 and the controlling part of the electronic controlled common rail type fuel injection pump were partly altered to make it possible to control the injection timing. The test was carried out under steady conditions (1200 rpm, 25% load equivalent conditions (input calorie between fuels was constant), fuel injection timing: 30° CA before top dead center, intake conditions: constant at normal temperature) to measure NOx, smoke and fuel consumption as well as effective ignition delay period. The effective ignition delay period is the value obtained by deducting the time required till ignition starts from the time required till fuel injection is completed. If the value is positive, it means that almost of all the injected fuel had enough time to be mixed with air, and thus homogeneous charge compression ignition combustion proceeds more effectively. Whereas, if the value is negative, it means that combustion starts before the fuel injection is completed, resulting in combustion which does not undergo sufficient premixing, accompanying extreme smoke generation. The fuel consumption was indicated by the relative value of the result of each composition against Comparative Example 4 which was set to 100 (lower value indicates better result).

The test method concerning engine test was carried out in accordance with Exhibit 29 "Technical Standard for 13-Mode Exhaust Emission Test Procedure for Diesel Powered Motor Vehicles" supervised by former Ministry of Transport Japan.

(Diesel Combustion Test)

A commercially available engine 1 with no alternation in compression ratio or injection system was used and operated at 3200 rpm-80% load equivalent conditions (input calorie between fuels was constant) to measure NOx, smoke and fuel consumption. The results of the fuel of Comparative Example 4 was defined as 100, and the results of the other fuels were relatively evaluated by comparison with the results of Comparative Example 4 (smaller values indicate better results).

(Low-temperature Startability Test)

An engine with the same alternation in compression ratio as the above-described commercially available engine 1 was equipped in a vehicle 1 described below. On a chassis dynamometer capable of controlling the environment temperature, each of the gas oil compositions was subjected to a test carried out at room temperature by (1) flashing (washing) the fuel system of a test diesel vehicle with a fuel to be evaluated; (2) draining out the flashing fuel; (3) replacing the main filter with new one; and (4) feeding the fuel tank with the fuel to be evaluated in a specific amount (½ of the tank volume of the test vehicle). The test was continued by (5) cooling rapidly the environment temperature from room temperature to 0° C.; (6) keeping the temperature at 0° C. for one hour; (7) cooling gradually at a rate of 1° C./h till reaching to the predetermined temperature (−10° C.); and (8) starting the engine after the temperature was kept at the predetermined temperature for one hour. If the engine did not start even after 10 second cranking was repeated twice at an interval of 30 seconds, the fuel was evaluated as "Poor" at this moment. If the engine started while 10 second cranking was repeated twice at an interval of 30 seconds, it was idled for 3 minutes and then the vehicle was speeded up to 60 km/h over 15 seconds and driven at the low speed. When defects in operation (hunting, stumble, vehicle speed reduction or engine stop) were observed while the vehicle was speeded up to 60 km/h and driven at that speed for 20 minutes, the gas oil composition was evaluated as "Not passed" at this moment. If the engine ran until the end without any defect, the gas oil composition was evaluated as "Passed".

(Vehicle specification): Vehicle 1

Type of engine: in-line 4 cylinder intercooled supercharged diesel engine with EGR Displacement: 1.4 L Internal diameter×stroke: 73 mm×81.4 mm Compression ratio: 18.5 (altered to 16.0)

Maximum output: 72 kW/4000 rpm

Adopted regulation: 2002 Exhaust Gas Emission Regulation

Vehicle weight: 1060 kg

Transmission: 5-speed manual transmission

Exhaust-gas post-processing device: oxidation Catalyst

Table 4

TABLE 4

| | | FT synthetic base oil 4 | FT synthetic base oil 5 | FT synthetic base oil 6 | Highly hydrogenated processed oil | Processed oil derived from animal or vegetable oil | Hydrorefined gas oil | Gas oil composition for low compression ratio |
|---|---|---|---|---|---|---|---|---|
| Density | (15° C.) kg/m$^3$ | 796 | 779 | 768 | 812 | 764 | 831 | 785 |
| Kinematic viscosity | (30° C.) mm$^2$/s | 4.3 | 3.1 | 2.3 | 3.5 | 2.2 | 4.4 | 3.0 |
| Distillation characteristics ° C. | 10% distillation temperature | 2.7 | 192.0 | 183.0 | 218.0 | 215.0 | 230.5 | 212.0 |
| | 50% distillation temperature | 247.5 | 250.0 | 249.0 | 271.0 | 249.0 | 292.0 | 249.0 |
| | 90% distillation temperature | 304.5 | 325.5 | 314.0 | 323.0 | 269.0 | 345.5 | 305.5 |
| Normal paraffin | mass % | 10.7 | 26.0 | 38.4 | 25.4 | 92.0 | 26.1 | 43.3 |
| Sulfur content | mass % | <1 | <1 | <1 | <1 | <1 | 7 | <1 |

TABLE 5

| | Example 4 | Example 5 | Example 6 | Comparative Example 4 | Comparative Example 5 | Comparative Example 6 |
|---|---|---|---|---|---|---|
| FT synthetic base oil 4 | 60 | 70 | 40 | | | 70 |
| FT synthetic base oil 5 | 20 | | 10 | | | |
| FT synthetic base oil 6 | | | | 100 | | |
| Highly hydrogenated processed oil | 20 | | | | | 20 |
| Processed oil derived from animal or vegetable oil | | 30 | | | | 10 |
| Hydrorefined gas oil | | | 50 | | 100 | |

TABLE 5-continued

| | | Example 4 | Example 5 | Example 6 | Comparative Example 4 | Comparative Example 5 | Comparative Example 6 |
|---|---|---|---|---|---|---|---|
| Gas oil composition for low compression ratio | | | | | | | 100 |
| Density | (15° C.) kg/m$^3$ | 796 | 786 | 811 | 768 | 831 | 785 |
| Kinematic viscosity | (30° C.) mm$^2$/s | 3.8 | 3.4 | 4.2 | 2.3 | 4.4 | 3.0 |
| Flash point | ° C. | 61 | 60 | 59 | 71 | 58 | 62 |
| Sulfur content | mass ppm | <1 | <1 | 4 | <1 | 7 | <1 |
| Oxygen content | mass ppm | <10 | <10 | 55 | 120 | 110 | <10 |
| Distillation characteristics ° C. | Initial boiling point | 164.0 | 181.0 | 165.0 | 159.0 | 178.0 | 178.0 |
| | 10% distillation temperature | 205.5 | 211.0 | 211.0 | 183.0 | 230.5 | 212.0 |
| | 50% distillation temperature | 250.0 | 248.0 | 259.0 | 249.0 | 292.0 | 249.0 |
| | 90% distillation temperature | 316.0 | 292.0 | 326.0 | 314.0 | 345.5 | 305.5 |
| | End point | 354.0 | 342.0 | 358.0 | 334.0 | 368.5 | 341.0 |
| E200-Eibp | Component ratio vol. % | 16.6 | 13.8 | 14.0 | 46.0 | 10.2 | 13.8 |
| | Cetane number | 26.5 | 33.1 | 34.0 | 62.0 | 38.0 | 49.0 |
| E280-E200 | Component ratio vol. % | 52.0 | 61.4 | 45.1 | 36.0 | 38.7 | 55.3 |
| | Cetane number | 41.8 | 52.0 | 53.2 | 81.0 | 58.0 | 70.8 |
| Eep-E280 | Component ratio vol. % | 31.4 | 24.8 | 40.9 | 30.0 | 51.1 | 30.9 |
| | Cetane number | 54.3 | 54.7 | 54.4 | 82.0 | 49.5 | 58.6 |
| Normal paraffin | mass % | 12.2 | 28.6 | 16.8 | 37.6 | 25.6 | 43.3 |
| Cetane index | | 65.8 | 72.0 | 61.2 | 80.0 | 60.7 | 72.7 |
| Cetane number | | 43.4 | 50.3 | 50.9 | 81.7 | 55.7 | 64.2 |
| Aromatic content | vol. % | <1 | <1 | 9.1 | <1 | 17.8 | <1 |
| Naphthene content | mass % | 12.0 | <1 | 14.0 | <1 | 40.3 | <1 |
| Bulk modulus | MPa | 1360 | 1330 | 1390 | 1190 | 1460 | 1320 |
| Cloud point | ° C. | −12.0 | −14.0 | −10.0 | −10.0 | −2.0 | −18.0 |
| Plugging point | ° C. | −15.0 | −16.0 | −18.0 | −12.0 | −5.0 | −20.0 |
| Pour point | ° C. | −20.0 | −22.5 | −20.0 | −15.0 | −7.5 | −22.5 |
| Hue (Saybolt) | | >+30 | >+30 | 28 | >+30 | +21 | >+30 |
| Carbon residue content of 10% distillation residue | mass % | 0.00 | 0.00 | 0.01 | 0.00 | 0.01 | 0.00 |
| Peroxide number | mass ppm | 4 | 4 | 21 | 1 | 54 | 0 |
| Wear scar diameter | (WS 1.4) μm | 360 | 360 | 340 | 420 | 450 | 350 |
| Insoluble content | mg/100 mL | 0.1 | 0.1 | 0.1 | 0.2 | 0.6 | 0.1 |
| Water content | vol. ppm | 6 | 13 | 7 | 47 | 44 | 12 |
| Lubricity improver | mg/L | 150 | 150 | 150 | 150 | 70 | 150 |
| Cold flow improver | mg/L | — | — | 150 | — | — | — |
| Detergent | mg/L | — | — | 100 | — | — | — |
| Cetane number improver | mg/L | — | — | — | — | — | — |

TABLE 6

| | | Example 4 | Example 5 | Example 6 | Comparative Example 4 | Comparative Example 5 | Comparative Example 6 |
|---|---|---|---|---|---|---|---|
| Homogeneous charge compression ignition combustion test | NO*x* ppm | 1 | 2 | 7 | 46 | 126 | 87 |
| | Smoke BSU | 0 | 0 | 0 | 1.0 | 2.6 | 1.9 |
| | Fuel consumption | 96 | 86 | 92 | 100 | 92 | 98 |
| | Effective ignition delay period ° CA | 2.9 | 1.6 | 1.4 | −4.5 | −3.0 | −3.7 |
| Diesel combustion test | NO*x* | 90 | 90 | 95 | 100 | 107 | 103 |
| | Smoke | 95 | 96 | 94 | 100 | 132 | 97 |
| | Fuel consumption | 92 | 91 | 93 | 100 | 91 | 97 |
| Low-temperature startability test | −10° C. | Passed | Passed | Passed | Not Passed | Passed | Passed |

Examples 7 to 9 and Comparative Examples 7 to 9

Base oils with characteristics set forth in Table 7 were blended to produce gas oil compositions set forth in Table 8 (Examples 7 to 9 and Comparative Examples 7 to 9). FT synthetic base oils 7 to 9 are hydrocarbon mixtures produced by converting natural gas to wax or a middle fraction through FT reaction, followed by hydrotreating. Since the reaction conditions (isomerization degree) vary, the resulting base oils vary in the ratio of the saturated hydrocarbon content. The highly hydrotreated base oil is a hydrocarbon base oil produced by further hydrotreating a gas oil base oil to further reduce the sulfur and aromatic contents. The processed oil derived from an animal or vegetable oil is an oil produced by hydrotreating palm oil (whole component) used as the raw material to remove the foreign substance. The hydrorefined gas oil corresponds to a commercially available gas oil which is used in a winter season. The fuel for low compression ratio is a fuel produced by blending the FT synthetic oils, hydrorefined base oil and highly hydrotreated base oil in suitable amounts, for a low pressure ratio diesel engine. Therefore, this fuel satisfies the requirements for the gas oil compositions of the present invention, other than the mixed ratio of each fraction and cetane number thereof. The compositions of Examples 7 to 9 and Comparative Examples 7 to 9 were produced by blending these base oils in suitable amounts or using any of the base oils as the whole.

The additives used in these examples are as follows:

Lubricity improver: carboxylic acid mixture mainly containing linoleic acid;

Detergent: alkenyl succinimide mixture

Cold flow improver: ethylene-vinyl acetate copolymer mixture

Table 8 sets forth the blend ratio of the gas oil compositions thus prepared and the 15° C. density, 30° C. kinematic viscosity, flash point, sulfur content, oxygen content, distillation characteristics, cetane index, cetane number, aromatic content, naphthene compound content, bulk modulus, cloud point, plugging point, pour point, hue, carbon residue content of the 10% distillation residue, insoluble content and peroxide number after an oxidation stability test, wear scar diameter and water content of each composition.

The gas oil compositions used in Examples 7 to 9 were produced by blending 20 percent by mass or more of the FT synthetic base oils as set forth in Table 5. Further, as apparent from Table 8, gas oil compositions satisfying the characteristics as defined herein were easily produced without fail, in Examples 7 to 9 wherein the FT synthetic base oils were blended within the range defined herein. On the other hand, as apparent from Comparative Examples 7 to 9, where the compositions were prepared not using the foregoing specific base oils and the composition was prepared using the specific base oils which, however, the component ratio of each fraction or the like does not satisfy the definition of the present invention, the gas oil compositions as intended by the present invention were not necessarily produced.

Next, the following various tests were carried out using the gas oil compositions of Examples 7 to 9 and Comparative Examples 7 to 9. All results are set forth in Table 9. As apparent from Table 9, the gas oil compositions of Examples 7 to 9 exhibited excellent results regarding NOx, smoke, fuel consumption and effective ignition delay period during homogeneous charge compression ignition combustion, and NOx, smoke, fuel consumption and low-temperature startability during normal combustion, compared with the gas oil compositions of Comparative Examples 7 to 9. Therefore, the gas oil compositions of Examples 7 to 9 were apparently high-quality gas oils that can achieve at a high level both an excellent practical performance under conditions in a winter season and environment friendly properties that can be applied to homogenous charge compression ignition combustion, which performance and properties were difficult to accomplish with the conventional gas oil compositions.

(Homogeneous Charge Compression Ignition Combustion Test)

The test was carried out using an engine for experiment wherein on the basis of the above-mentioned commercially available engine 1 described below, the shape of the pistons of all the cylinders were changed to alter the compression ratio to 16 and the controlling part of the electronic controlled common rail type fuel injection pump are partly altered to make it possible to control the injection timing. The test was carried out under steady conditions (1200 rpm, 25% load equivalent conditions (input calorie between fuels was constant), fuel injection timing: 30° CA before top dead center, intake conditions: constant at normal temperature) to measure NOx, smoke and fuel consumption as well as effective ignition delay period. The effective ignition delay period is the value obtained by deducting the time required till ignition starts from the time required till fuel injection is completed. If the value is positive, it means that almost of all the injected fuel had enough time to be mixed with air, and thus homogeneous charge compression ignition combustion proceeds more effectively. Whereas, if the value is negative, it means that combustion starts before the fuel injection is completed, resulting in combustion which does not undergo sufficient premixing, accompanying extreme smoke generation. The fuel consumption was indicated by the relative value of the result of each composition against Comparative Example 7 which was set to 100 (lower value indicates better result).

The test concerning engine test was carried out in accordance with Exhibit 29 "Technical Standard for 13-Mode Exhaust Emission Test Procedure for Diesel Powered Motor Vehicles" supervised by former Ministry of Transport Japan.

(Diesel Combustion Test)

The commercially available engine 1 with no alternation in compression ratio or injection system was used and operated at 3200 rpm-80% load equivalent conditions (input calorie between fuels was constant) to measure NOx, smoke and fuel consumption. The results of the fuel of Comparative Example 7 was defined as 100, and the results of the other fuels were relatively evaluated by comparison with the results of Comparative Example 7 (smaller values indicate better results).

(Low-temperature Startability Test)

An engine with the same alternation in compression ratio as the above-described commercially available engine 1 was equipped in the above-mentioned vehicle 1 described below. On a chassis dynamometer capable of controlling the environment temperature, each of the gas oil compositions was subjected to a test carried out at room temperature by (1) flashing (washing) the fuel system of a test diesel vehicle with a fuel to be evaluated; (2) draining out the flashing fuel; (3) replacing the main filter with new one; and (4) feeding the fuel tank with the fuel to be evaluated in a specific amount (½ of the tank volume of the test vehicle). The test was continued by (5) cooling rapidly the environment temperature from room temperature to −5° C.; (6) keeping the temperature at −5° C. for one hour; (7) cooling gradually at a rate of 1° C./h till reaching to the predetermined temperature (−15° C.); and (8) starting the engine after the temperature was kept at the predetermined temperature for one hour. If the engine did not start even after 10 second cranking was repeated twice at an interval of 30 seconds, the fuel was evaluated as "Not passed" at this moment. If the engine started while 10 second cranking was repeated twice at an interval of 30 seconds, it was idled for 3 minutes and then the vehicle was speeded up to 60 km/h over 15 seconds and driven at the low speed. When defects in operation (hunting, stumble, vehicle speed reduction or engine stop) were observed while the vehicle was speeded up to 60 km/h and driven at that speed for 20 minutes, the gas oil composition was evaluated as "Not passed" at this moment. If the engine ran until the end without any defect, the gas oil composition was evaluated as "Passed".

TABLE 7

| | | FT synthetic base oil 7 | FT synthetic base oil 8 | FT synthetic base oil 9 | Highly hydrogenated processed oil | Processed oil derived from animal or vegetable oil | Hydrorefined gas oil | Gas oil composition for low compression ratio |
|---|---|---|---|---|---|---|---|---|
| Density | (15° C.) kg/m$^3$ | 790 | 776 | 768 | 805 | 764 | 822 | 777 |
| Kinematic viscosity | (30° C.) mm$^2$/s | 3.4 | 2.7 | 2.3 | 2.8 | 2.2 | 3.2 | 2.5 |
| Distillation characteristics ° C. | 10% distillation temperature | 196.0 | 186.0 | 183.0 | 194.0 | 215.0 | 194.0 | 197.0 |
| | 50% distillation temperature | 240.5 | 239.5 | 249.0 | 253.0 | 249.0 | 264.0 | 233.5 |
| | 90% distillation temperature | 289.0 | 319.0 | 314.0 | 317.0 | 269.0 | 328.5 | 305.5 |
| Normal paraffin | mass % | 10.8 | 24.2 | 38.4 | 26.1 | 92.0 | 26.2 | 49.6 |
| Sulfur content | mass % | <1 | <1 | <1 | <1 | <1 | 7 | <1 |

TABLE 8

| | | Example 7 | Example 8 | Example 9 | Comparative Example 7 | Comparative Example 8 | Comparative Example 9 |
|---|---|---|---|---|---|---|---|
| FT synthetic base oil 7 | | 60 | 50 | 50 | | | |
| FT synthetic base oil 8 | | 20 | 20 | | | | |
| FT synthetic base oil 9 | | | | | 100 | | |
| Highly hydrogenated processed oil | | 20 | | 20 | | | |
| Processed oil derived from animal or vegetable oil | | | 30 | | | | |
| Hydrorefined gas oil | | | | 30 | | 100 | |
| Gas oil composition for low compression ratio | | | | | | | 100 |
| Density | (15° C.) kg/m$^3$ | 790 | 779 | 803 | 768 | 822 | 777 |
| Kinematic viscosity | (30° C.) mm$^2$/s | 3.1 | 2.9 | 3.2 | 2.3 | 3.2 | 2.5 |
| Flash point | ° C. | 58 | 62 | 59 | 71 | 55 | 60 |
| Sulfur content | mass ppm | <1 | <1 | 2 | <1 | 7 | <1 |
| Oxygen content | mass ppm | <10 | <10 | 43 | 120 | 104 | <10 |
| Distillation characteristics ° C. | Initial boiling point | 158.0 | 161.0 | 169.5 | 159.0 | 166.0 | 170.0 |
| | 10% distillation temperature | 193.5 | 198.0 | 195.5 | 183.0 | 194.0 | 197.0 |
| | 50% distillation temperature | 242.5 | 242.5 | 246.5 | 249.0 | 264.0 | 233.5 |
| | 90% distillation temperature | 306.0 | 291.0 | 314.0 | 314.0 | 328.5 | 305.5 |
| | End point | 341.0 | 335.5 | 352.0 | 334.0 | 352.0 | 346.5 |
| E200-Eibp | Component ratio vol. % | 26.4 | 21.9 | 23.4 | 46.0 | 20.6 | 25.3 |
| | Cetane number | 27.9 | 36.7 | 31.9 | 62.0 | 35.5 | 48.0 |
| E280-E200 | Component ratio vol. % | 50.4 | 56.2 | 47.9 | 36.0 | 35.7 | 48.7 |
| | Cetane number | 40.2 | 51.1 | 54.2 | 81.0 | 59.6 | 67.2 |
| Eep-E280 | Component ratio vol. % | 23.2 | 21.8 | 28.6 | 30.0 | 43.7 | 26.0 |
| | Cetane number | 55.3 | 55.8 | 55.6 | 82.0 | 46.9 | 55.7 |
| Normal paraffin | mass % | 12.2 | 32.4 | 15.1 | 37.6 | 25.8 | 49.6 |
| Cetane index | | 65.9 | 72.9 | 60.8 | 80.0 | 56.1 | 70.0 |
| Cetane number | | 42.0 | 48.7 | 49.5 | 81.7 | 57.6 | 59.1 |
| Aromatic content | vol. % | <1 | <1 | 5.4 | <1 | 18.1 | <1 |
| Naphthene content | mass % | 11.5 | <1 | 19.8 | <1 | 27.7 | 11.5 |
| Bulk modulus | MPa | 1300 | 1310 | 1400 | 1190 | 1410 | 1300 |
| Cloud point | ° C. | −18.0 | −19.0 | −15.0 | −10.0 | −8.0 | −18.0 |
| Plugging point | ° C. | −21.0 | −23.0 | −22.0 | −12.0 | −14.0 | −20.0 |
| Pour point | ° C. | −27.5 | −30.0 | −27.5 | −15.0 | −21.0 | −27.5 |
| Hue (Saybolt) | | >+30 | >+30 | 29 | >+30 | +21 | >+30 |
| Carbon residue content of 10% distillation residue | mass % | 0.00 | 0.00 | 0.01 | 0.00 | 0.01 | 0.00 |
| Peroxide number | mass ppm | 4 | 1 | 11 | 1 | 51 | 4 |
| Wear scar diameter | (WS 1.4) μm | 360 | 360 | 360 | 420 | 460 | 360 |
| Insoluble content | mg/100 mL | 0.1 | 0.1 | 0.1 | 0.2 | 0.4 | 0.1 |
| Water content | vol. ppm | 6 | 11 | 15 | 47 | 41 | 15 |
| Lubricity improver | mg/L | 150 | 150 | 150 | 150 | 70 | 150 |
| Cold flow improver | mg/L | — | — | 150 | — | 150 | — |
| Detergent | mg/L | — | — | 100 | — | — | — |
| Cetane number improver | mg/L | — | — | — | — | — | — |

TABLE 9

| | | Example 7 | Example 8 | Example 9 | Comparative Example 7 | Comparative Example 8 | Comparative Example 9 |
|---|---|---|---|---|---|---|---|
| Homogeneous charge compression ignition combustion test | NOx ppm | 5 | 4 | 9 | 46 | 108 | 113 |
| | Smoke BSU | 0 | 0 | 0 | 1.0 | 1.4 | 1.6 |
| | Fuel consumption | 91 | 86 | 92 | 100 | 96 | 94 |
| | Effective ignition delay period ° CA | 3.1 | 2.3 | 2.1 | −4.5 | −3.0 | −3.3 |
| Diesel combustion test | NOx | 91 | 91 | 93 | 100 | 103 | 98 |
| | Smoke | 98 | 95 | 98 | 100 | 126 | 112 |
| | Fuel consumption | 89 | 88 | 94 | 100 | 94 | 100 |
| Low-temperature startability test | −15° C. | Passed | Passed | Passed | Not passed | Not passed | Passed |

Examples 10 to 12 and Comparative Examples 10 to 12

Base oils with characteristics set forth in Table 10 were blended to produce gas oil compositions set forth in Table 11 (Examples 10 to 12 and Comparative Examples 10 to 12). FT synthetic base oils 10 to 12 are hydrocarbon mixtures produced by converting natural gas to wax or a middle fraction through FT reaction, followed by hydrotreating. Since the reaction conditions (isomerization degree) vary, the resulting base oils vary in the ratio of the saturated hydrocarbon content. The highly hydrotreated base oil is a hydrocarbon base oil produced by further hydrotreating a gas oil base oil to further reduce the sulfur and aromatic contents. The processed oil derived from an animal or vegetable oil is an oil produced by hydrotreating palm oil (whole component) used as the raw material to remove the foreign substance. The hydrorefined gas oil corresponds to a commercially available gas oil which is used in a winter season. The fuel for low compression ratio is a fuel produced by blending the FT synthetic oils, hydrorefined base oil and highly hydrotreated base oil in suitable amounts, for a low pressure ratio diesel engine. Therefore, this fuel satisfies the requirements for the gas oil compositions of the present invention, other than the mixed ratio of each fraction and cetane number thereof. The compositions of Examples 10 to 12 and Comparative Examples 10 to 12 were produced by blending these base oils in suitable amounts or using any of the base oils as the whole.

The additives used in these examples are as follows:

Lubricity improver: carboxylic acid mixture mainly containing linoleic acid;

Detergent: alkenyl succinimide mixture

Cold flow improver: ethylene-vinyl acetate copolymer mixture

Table 11 sets forth the blend ratio of the gas oil compositions thus prepared and the 15° C. density, 30° C. kinematic viscosity, flash point, sulfur content, oxygen content, distillation characteristics, cetane index, cetane number, aromatic content, naphthene compound content, bulk modulus, cloud point, plugging point, pour point, hue, carbon residue content of the 10% distillation residue, insoluble content and peroxide number after an oxidation stability test, wear scar diameter and water content of each composition.

The gas oil compositions used in Examples 10 to 12 were produced by blending 20 percent by mass or more of the FT synthetic base oils as set forth in Table 11. Further, as apparent from Table 11, gas oil compositions satisfying the characteristics as defined herein were easily produced without fail, in Examples 10 to 12 wherein the FT synthetic base oils were blended within the range defined in the present invention. On the other hand, as apparent from Comparative Examples 10 to 12, where the compositions were prepared not using the foregoing specific base oils and the composition was prepared using the specific base oils which, however, the component ratio of each fraction or the like does not satisfy the definition of the present invention, the gas oil compositions as intended by the present invention were not necessarily produced.

Next, the following various tests were carried out using the gas oil compositions of Examples 10 to 12 and Comparative Examples 10 to 12. All results are set forth in Table 12. As apparent from Table 12, the gas oil compositions of Examples 10 to 12 exhibited excellent results regarding NOx, smoke, fuel consumption and effective ignition delay period during homogeneous charge compression ignition combustion, and NOx, smoke, fuel consumption and low-temperature startability during normal combustion, compared with the gas oil compositions of Comparative Examples 10 to 12. Therefore, the gas oil compositions of Examples 10 to 12 are apparently high-quality gas oils that can achieve at a high level and the same time an excellent practical performance under conditions in a winter season and environment friendly properties that can be applied to homogenous charge compression ignition combustion, which performance and properties were difficult to accomplish with the conventional gas oil compositions.

(Homogeneous Charge Compression Ignition Combustion Test)

The test was carried out using an engine for experiment wherein on the basis of the above-mentioned commercially available engine 1 described below, the shape of the pistons of all the cylinders were changed to alter the compression ratio to 16 and the controlling part of the electronic controlled common rail type fuel injection pump were partly altered to make it possible to control the injection timing. The test was carried out under steady conditions (1200 rpm, 25% load equivalent conditions (input calorie between fuels was constant), fuel injection timing: 30° CA before top dead center, intake conditions: constant at normal temperature) to measure NOx, smoke and fuel consumption as well as effective ignition delay period. The effective ignition delay period is the value obtained by deducting the time required till ignition starts from the time required till fuel injection is completed. If the value is positive, it means that almost of all the injected fuel had enough time to be mixed with air, and thus homogeneous charge compression ignition combustion proceeds more effectively. Whereas, if the value is negative, it means that combustion starts before the fuel injection is completed, resulting in combustion which does not undergo extreme premixing, accompanying sufficient smoke generation. The fuel consumption was indicated by the relative value of the result of each composition against Comparative Example 7 which was set to 100 (lower value indicates better result).

The test concerning engine test was carried out in accordance with Exhibit 29 "Technical Standard for 13-Mode Exhaust Emission Test Procedure for Diesel Powered Motor Vehicles" supervised by former Ministry of Transport Japan.

(Diesel Combustion Test)

The commercially available engine 1 with no alternation in compression ratio or injection system was used and operated at 3200 rpm-80% load equivalent conditions (input calorie between fuels was constant) to measure NOx, smoke and fuel consumption. The results of the fuel of Comparative Example 10 was defined as 100, and the results of the other fuels were relatively evaluated by comparison with the results of Comparative Example 10 (smaller values indicate better results).

(Low-temperature Startability Test)

An engine with the same alternation in compression ratio as the above-described commercially available engine 1 was equipped in the above-mentioned vehicle 1 described below. On a chassis dynamometer capable of controlling the environment temperature, each of the gas oil compositions was subjected to a test carried out at room temperature by (1) flashing (washing) the fuel system of a test diesel vehicle with a fuel to be evaluated; (2) draining out the flashing fuel; (3) replacing the main filter with new one; and (4) feeding the fuel tank with the fuel to be evaluated in a specific amount (½ of the tank volume of the test vehicle). The test was continued by (5) cooling rapidly the environment temperature from room temperature to −15° C.; (6) keeping the temperature at −15° C. for one hour; (7) cooling gradually at a rate of 1° C./h till reaching to the predetermined temperature (−25° C.); and (8) starting the engine after the temperature was kept at the predetermined temperature for one hour. If the engine did not start even after 10 second cranking was repeated twice at an interval of 30 seconds, the fuel was evaluated as "Not passed" at this moment. If the engine started while 10 second cranking was repeated twice at an interval of 30 seconds, it was idled for 3 minutes and then the vehicle was speeded up to 60 km/h over 15 seconds and driven at the low speed. When defects in operation (hunting, stumble, vehicle speed reduction or engine stop) were observed while the vehicle was speeded up to 60 km/h and driven at that speed for 20 minutes, the gas oil composition was evaluated as "Not passed" at this moment. If the engine ran until the end without any defect, the gas oil composition was evaluated as "Passed".

TABLE 10

| | | FT synthetic base oil 10 | FT synthetic base oil 11 | FT synthetic base oil 12 | Highly hydrogenated processed oil | Processed oil derived from animal or vegetable oil | Hydrorefined gas oil | Gas oil composition for low compression ratio |
|---|---|---|---|---|---|---|---|---|
| Density | (15° C.) kg/m$^3$ | 782 | 769 | 768 | 802 | 764 | 810 | 768 |
| Kinematic viscosity | (30° C.) mm$^2$/s | 2.7 | 2.1 | 2.3 | 2.5 | 2.2 | 2.2 | 2.1 |
| Distillation characteristics ° C. | 10% distillation temperature | 185.0 | 178.0 | 183.0 | 189.0 | 227.0 | 180.0 | 186.5 |
| | 50% distillation temperature | 194.5 | 192.5 | 249.0 | 243.0 | 249.0 | 219.0 | 209.0 |
| | 90% distillation temperature | 289.5 | 300.5 | 314.0 | 314.0 | 268.0 | 315.0 | 276.5 |
| Normal paraffin | mass % | 5.2 | 21.0 | 37.6 | 26.3 | 86.1 | 26.2 | 39.8 |
| Sulfur content | mass % | <1 | <1 | <1 | <1 | <1 | 7 | <1 |

TABLE 11

| | | Example 10 | Example 11 | Example 12 | Comparative Example 10 | Comparative Example 11 | Comparative Example 12 |
|---|---|---|---|---|---|---|---|
| FT synthetic base oil 10 | | 80 | | 10 | | | |
| FT synthetic base oil 11 | | | 70 | 40 | | | |
| FT synthetic base oil 12 | | | | | 100 | | |
| Highly hydrogenated processed oil | | | 30 | | | | |
| Processed oil derived from animal or vegetable oil | | 20 | | | | | |
| Hydrorefined gas oil | | | | 50 | | 100 | |
| Gas oil composition for low compression ratio | | | | | | | 100 |
| Density | (15° C.) kg/m$^3$ | 778 | 779 | 790 | 768 | 810 | 768 |
| Kinematic viscosity | (30° C.) mm$^2$/s | 2.6 | 2.2 | 2.2 | 2.3 | 2.2 | 2.1 |
| Flash point | ° C. | 53 | 53 | 52 | 71 | 53 | 54 |
| Sulfur content | mass ppm | <1 | <1 | 4 | <1 | 7 | <1 |
| Oxygen content | mass ppm | <10 | <10 | 51 | 120 | 102 | <10 |
| Distillation characteristics ° C. | Initial boiling point | 169.0 | 150.0 | 150.0 | 159.0 | 161.0 | 154.5 |
| | 10% distillation temperature | 186.5 | 180.0 | 180.0 | 183.0 | 179.0 | 186.5 |
| | 50% distillation temperature | 218.0 | 207.0 | 208.0 | 249.0 | 219.0 | 209.0 |
| | 90% distillation temperature | 283.0 | 305.5 | 308.0 | 314.0 | 316.0 | 276.5 |
| | End point | 331.0 | 350.0 | 355.0 | 334.0 | 354.0 | 318.0 |
| E200-Eibp | Component ratio vol. % | 43.0 | 45.6 | 44.9 | 46.0 | 36.2 | 46.2 |
| | Cetane number | 33.0 | 29.6 | 31.8 | 62.0 | 35.7 | 46.5 |
| E280-E200 | Component ratio vol. % | 38.8 | 31.5 | 32.2 | 36.0 | 36.4 | 40.9 |
| | Cetane number | 48.9 | 44.4 | 41.2 | 81.0 | 59.2 | 66.9 |
| Eep-E280 | Component ratio vol. % | 18.2 | 22.8 | 22.9 | 30.0 | 27.4 | 12.9 |
| | Cetane number | 58.5 | 55.2 | 55.7 | 82.0 | 49.5 | 58.5 |
| Normal paraffin | mass % | 21.4 | 22.6 | 22.0 | 37.6 | 26.2 | 39.8 |
| Cetane index | | 63.8 | 57.5 | 53.3 | 80.0 | 49.1 | 65.7 |
| Cetane number | | 44.1 | 40.5 | 41.0 | 81.7 | 50.1 | 56.1 |
| Aromatic content | vol. % | <1 | <1 | 8.9 | <1 | 17.9 | <1 |
| Naphthene content | mass % | <1 | 16.8 | 13.6 | <1 | 27.2 | <1 |

TABLE 11-continued

| | | Example 10 | Example 11 | Example 12 | Comparative Example 10 | Comparative Example 11 | Comparative Example 12 |
|---|---|---|---|---|---|---|---|
| Bulk modulus | MPa | 1300 | 1310 | 1340 | 1190 | 1360 | 1310 |
| Cloud point | ° C. | <−25 | −26.0 | −25.0 | −10.0 | −14.0 | <−25 |
| Plugging point | ° C. | <−35 | −31.0 | −29.0 | −12.0 | −21.0 | <−35 |
| Pour point | ° C. | <−45 | −35.0 | −35.0 | −15.0 | −32.5 | <−45 |
| Hue (Saybolt) | | >+30 | >+30 | 29 | >+30 | +27 | >+30 |
| Carbon residue content of 10% distillation residue | mass % | 0.00 | 0.00 | 0.01 | 0.00 | 0.01 | 0.00 |
| Peroxide number | mass ppm | 4 | 1 | 12 | 1 | 51 | 1 |
| Wear scar diameter | (WS 1.4) μm | 360 | 360 | 360 | 420 | 450 | 360 |
| Insoluble content | mg/100 mL | 0.1 | 0.1 | 0.1 | 0.2 | 0.2 | 0.1 |
| Water content | vol. ppm | 12 | 17 | 17 | 47 | 21 | 3 |
| Lubricity improver | mg/L | 150 | 150 | 150 | 150 | 150 | 150 |
| Cold flow improver | mg/L | — | — | 300 | — | 300 | — |
| Detergent | mg/L | — | — | 100 | — | — | — |
| Cetane number improver | mg/L | — | — | — | — | — | — |

TABLE 12

| | | Example 10 | Example 11 | Example 12 | Comparative Example 10 | Comparative Example 11 | Comparative Example 12 |
|---|---|---|---|---|---|---|---|
| Homogeneous charge compression ignition combustion test | NO*x* ppm | 2 | 2 | 4 | 46 | 108 | 75 |
| | Smoke BSU | 0 | 0 | 0 | 1 | 1.4 | 1.9 |
| | Fuel consumption | 87 | 85 | 85 | 100 | 96 | 109 |
| | Effective ignition delay period ° CA | 3.1 | 3.3 | 3.1 | −4.5 | −0.6 | −2.8 |
| Diesel combustion test | NO*x* | 95 | 98 | 98 | 100 | 105 | 98 |
| | Smoke | 93 | 98 | 97 | 100 | 122 | 122 |
| | Fuel consumption | 97 | 99 | 96 | 100 | 97 | 97 |
| Low-temperature startability test | −25° C. | Passed | Passed | Passed | Not passed | Not passed | Passed |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. The gas oil composition with quality items fulfilling the JIS No. 1 grade gas oil standards other than sulfur content for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a HFRR wear scar diameter at WS 1.4 of 400 μm or less, an initial boiling point of 140° C. or higher and an end point of 380° C. or lower in distillation characteristics, and the following characteristics (1) to (3) in each fraction range:

(1) the cetane number in a fraction range of 140° C. or higher and lower than 200° C. is 20 or greater and less than 40, and the component ratio of the fraction in the whole fraction volume is 1 percent by volume or more and less than 10 percent by volume;

(2) the cetane number in a fraction range of 200° C. or higher and lower than 280° C. is 30 or greater and less than 60, and the component ratio of the fraction in the whole fraction volume is 40 percent by volume or more and 98 percent by volume or less; and (3) the cetane number in a fraction range of 280° C. or higher and 380° C. is 50 or greater, and the component ratio of the fraction in the whole fraction volume is 1 percent by volume or more and 59 percent by volume or less, wherein the gas oil composition has a density at 15° C. of 760 kg/m$^3$ or higher and 840 kg/m$^3$ or lower, a flash point of 50° C. or higher, an aromatic content of less than 1 percent by volume, a cold filter plugging point of −1° C. or lower, a pour point of −2.5° C. or lower, a kinematic viscosity at 30° C. of 2.7 mm$^2$/s or higher, and wherein the composition comprises a carbon residue of a 10% distillation residue of 0.1 percent by mass or less.

2. The gas oil composition according to claim 1 with quality items fulfilling the JIS No. 2 grade gas oil standards other than sulfur content for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a HFRR wear scar diameter at WS 1.4 of 400 μm or less, an initial boiling point of 140° C. or higher and an end point of 360° C. or lower in distillation characteristics, and the following characteristics (1) to (3) in each fraction range:

(1) the cetane number in a fraction range 140° or higher and lower than 200° C. is 20 or greater and less than 40, and the component ratio of the fraction in the whole fraction volume is 10 percent by volume or more and less than 16.6 percent by volume;

(2) the cetane number in a fraction range of 200° C. or higher and lower than 280° C. is 30 or greater and less than 60, and the component ratio of the fraction in the whole fraction volume is 30 percent by volume or more and 89 percent by volume or less; and (3) the cetane number in a fraction range of 280° C. or higher is 50 or greater, and the component ratio of the fraction in the whole fraction volume is 1 percent by volume or more and 60 percent by volume or less, wherein the gas oil composition has a density at 15° C. of 760 kg/m$^3$ or higher and 840 kg/m$^3$ or lower, a flash point of 50° C. or higher, an aromatic content of less than 1 percent by volume, a cold filter plugging point of −5° C. or lower, a pour point of −7.5° C. or lower, a kinematic viscosity at 30° C. of 2.5 mm$^2$/s or higher, and wherein the composition comprises a carbon residue of a 10% distillation residue of 0.1 percent by mass or less.

3. The gas oil composition according to claim 1 with quality items fulfilling the JIS No. 3 grade gas oil standards other than sulfur content for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a HFRR wear scar diameter at WS 1.4 of 400 μm or less, an initial boiling point of 140° C. or higher and an end point of 360° C. or lower in distillation characteristics, and the following characteristics (1) to (3) in each fraction range:

(1) the cetane number in a fraction range of 140° or higher and lower than 200° C. is 20 or greater and less than 40, and the component ratio of the fraction in the whole fraction volume is 20 percent by volume or more and less than 40 percent by volume;

(2) the cetane number in a fraction range of 200° C. or higher and lower than 280° C. is 30 or greater and less than 60, and the component ratio of the fraction in the whole fraction volume is 30 percent by volume or more and 78 percent by volume or less; and (3) the cetane number in a fraction range of 280° C. or higher and 360° C. or lower is 50 or greater, and the component ratio of the fraction in the whole fraction volume is 1 percent by volume or more and 50 percent by volume or less, wherein the gas oil composition has a density at 15° C. of 760 kg/m$^3$ or higher and 840 kg/m$^3$ or lower, a flash point of 45° C. or higher, an aromatic content of less than 1 percent by volume, a cold filter plugging point of −12° C. or lower, a pour point of −20° C. or lower, a kinematic viscosity at 30° C. of 2.0 mm$^2$/s or higher, and wherein the composition comprises a carbon residue of a 10% distillation residue of 0.1 percent by mass or less.

4. A gas oil composition with quality items fulfilling the JIS Special No. 3 grade gas oil standards other than sulfur content and density for use in a diesel engine with a geometric compression ratio of greater than 16 equipped with a supercharger and an EGR, containing an FT synthetic base oil and having a sulfur content of 5 ppm by mass or less, an oxygen content of 100 ppm by mass or less, a bulk modulus of 1250 MPa or greater and 1450 MPa or less, a saybolt color of +22 or greater, a HFRR wear scar diameter at WS 1.4 of 400 μm or less, an initial boiling point of 140° C. or higher and an end point of 350° C. or lower in distillation characteristics, and wherein the gas oil exhibits the following characteristics (1) to (3) in each fraction range:

(1) the cetane number in a fraction range of 140° C. or higher and lower than 200° C. is 20 or greater and less than 40, and the component ratio of the fraction in the whole fraction volume is 40 percent by volume or more and 70 percent by volume or less;

(2) the cetane number in a fraction range of 200° C. or higher and lower than 280° C. is 30 or greater and less than 60, and the component ratio of the fraction in the whole fraction volume is 20 percent by volume or more and 59 percent by volume or less; and (3) the cetane number in a fraction range of 280° C. or higher and 350° C. or lower is 50 or greater, and the component ratio of the fraction in the whole fraction volume is 1 percent by volume or more and 30 percent by volume or less, wherein the gas oil composition has a density at 15° C. of 760 kg/m$^3$ or higher and 840 kg/m$^3$ or lower, a flash point of 45° C. or higher, an aromatic content of less than 1 percent by volume, a cold filter plugging point of −19° C. or lower, a pour point of −30° C. or lower, a kinematic viscosity at 30° C. of 1.7 mm$^2$/s or higher, and wherein the composition comprises a carbon residue of a 10% distillation residue of 0.1 percent by mass or less.

5. The gas oil composition according to claim 1, wherein the peroxide number after an accelerated oxidation test is 50 ppm by mass or less.

6. The gas oil composition according to claim 1, wherein the blend ratio of the FT synthetic base oil is 20 percent by volume or more.

7. The gas oil composition according to claim 2, wherein the peroxide number after an accelerated oxidation test is 50 ppm by mass or less.

8. The gas oil composition according to claim 2, wherein the blend ratio of the FT synthetic base oil is 20 percent by volume or more.

9. The gas oil composition according to claim 3, wherein the peroxide number after an accelerated oxidation test is 50 ppm by mass or less.

10. The gas oil composition according to claim 3, wherein the blend ratio of the FT synthetic base oil is 20 percent by volume or more.

11. The gas oil composition according to claim 4, wherein the peroxide number after an accelerated oxidation test is 50 ppm by mass or less.

12. The gas oil composition according to claim 4, wherein the blend ratio of the FT synthetic base oil is 20 percent by volume or more.

* * * * *